US008217712B2

(12) United States Patent
Miyatake et al.

(10) Patent No.: US 8,217,712 B2
(45) Date of Patent: Jul. 10, 2012

(54) SEMICONDUCTOR DEVICE THAT CAN ADJUST SUBSTRATE VOLTAGE

(75) Inventors: Shinichi Miyatake, Tokyo (JP); Seiji Narui, Tokyo (JP); Hitoshi Tanaka, Tokyo (JP)

(73) Assignee: Elpida Memory, Inc., Tokyo (JP)

( * ) Notice: Subject to any disclaimer, the term of this patent is extended or adjusted under 35 U.S.C. 154(b) by 253 days.

(21) Appl. No.: 12/647,259

(22) Filed: Dec. 24, 2009

(65) Prior Publication Data

US 2010/0164607 A1 Jul. 1, 2010

(30) Foreign Application Priority Data

Dec. 25, 2008 (JP) ..... 2008-331209

(51) Int. Cl.
*G05F 1/10* (2006.01)
*G05F 3/02* (2006.01)

(52) U.S. Cl. ..... 327/537; 327/536; 362/59; 362/60

(58) Field of Classification Search ..... 327/148, 327/157, 534–537; 363/59, 60
See application file for complete search history.

(56) References Cited

U.S. PATENT DOCUMENTS

| | | | | |
|---|---|---|---|---|
| 7,504,876 | B1 * | 3/2009 | Raghavan et al. | 327/536 |
| 2005/0189973 | A1 * | 9/2005 | Li | 327/157 |
| 2006/0192611 | A1 * | 8/2006 | Bonaccio et al. | 327/543 |
| 2008/0054262 | A1 | 3/2008 | Nakaya et al. | |
| 2009/0289614 | A1 * | 11/2009 | Tu et al. | 323/313 |
| 2010/0097128 | A1 * | 4/2010 | Sumita | 327/537 |
| 2010/0244908 | A1 * | 9/2010 | Miyatake et al. | 327/109 |
| 2010/0244936 | A1 * | 9/2010 | Miyatake et al. | 327/537 |
| 2010/0289563 | A1 * | 11/2010 | Katz et al. | 327/543 |

FOREIGN PATENT DOCUMENTS

JP 2008-059680 A 3/2008

* cited by examiner

*Primary Examiner* — Lincoln Donovan
*Assistant Examiner* — Brandon s Cole
(74) *Attorney, Agent, or Firm* — Sughrue Mion, PLLC

(57) ABSTRACT

To provide a semiconductor device including: a MOS transistor formed in a semiconductor substrate and have a threshold voltage to be adjusted, a replica transistor of the MOS transistor, a monitoring circuit monitors a gate/source voltage needed when the replica transistor flows a current having a given designed value, a negative voltage pumping circuit generates a substrate voltage of the MOS transistor, based on an output from the monitoring circuit, and a limiting circuit defines the operation of the negative voltage pumping circuit, regardless of a monitoring result of the monitoring circuit, in response to an excess of the substrate voltage with respect to a predetermined value.

10 Claims, 18 Drawing Sheets

SEMICONDUCTOR DEVICE THAT CAN ADJUST SUBSTRATE VOLTAGE

BACKGROUND OF THE INVENTION

1. Field of the Invention

The present invention relates to a semiconductor device and more particularly, to a semiconductor device including a MOS transistor that can adjust a substrate voltage.

2. Description of Related Art

In recent years, in semiconductor devices, a threshold voltage of a MOS transistor decreases in order to increase a switching speed and decrease power consumption. For example, in a dynamic random access memory (DRAM) that is an example of a representative semiconductor device, an operation voltage decreases to about 1 V. As a result, the threshold voltage of the MOS transistor also decreases to about 0 V.

Meanwhile, the threshold voltage of the MOS transistor is inevitably varied due to a process condition or a position on a wafer. As such, when the threshold voltage decreases, the variation in the threshold voltage particularly causes a problem in a circuit where a high sensitive operation is needed, for example, a sense amplifier that amplifies a small potential difference. Japanese Patent Application Laid-Open (JP-A) No. 2008-59680 discloses a method of controlling a substrate voltage of a MOS transistor to compensate for a variation in a threshold voltage.

However, in a recent minute transistor, since a substrate effect coefficient of the MOS transistor is small, the amount of the threshold voltage that can be adjusted by the substrate voltage is small. For this reason, if the substrate voltage is continuously varied to maintain the threshold voltage at a designed value, a variation width of a substrate potential may extraordinarily increase. This may vary a characteristic of another transistor whose threshold voltage does not need to be adjusted.

For example, when the MOS transistor whose threshold voltage needs to be adjusted is an N-channel MOS transistor constituting the sense amplifier, a characteristic of the MOS transistor constituting a memory cell may be deteriorated. Specifically, if the substrate voltage excessively increases, a charge of a memory cell capacitor is lost due to a subthreshold leak. In contrast, if the substrate voltage excessively decreases, the charge of the memory cell capacitor is lost due to a junction leak of a substrate with respect to a diffusion layer. Accordingly, the substrate voltage needs to be adjusted in a range of upper and lower limits not causing the leaks to increase.

SUMMARY

The present invention seeks to solve one or more of the above problems, or to improve upon those problems at least in part.

In one embodiment, there is provided a semiconductor device, comprising: a first MOS transistor formed in a semiconductor substrate; a replica transistor of the first MOS transistor; a monitoring circuit monitors a gate/source voltage needed when the replica transistor flows a current having a given designed value; a voltage generating circuit generates a substrate voltage of the first MOS transistor, based on an output from the monitoring circuit; and a limiting circuit defines the operation of the voltage generating circuit, regardless of a monitoring result of the monitoring circuit, in response to an excess of the substrate voltage with respect to a predetermined value.

According to the present invention, even though the substrate voltage is controlled in order to adjust the threshold voltage of the MOS transistor, the substrate voltage can be maintained in an appropriate range.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposes.

Figure 1:
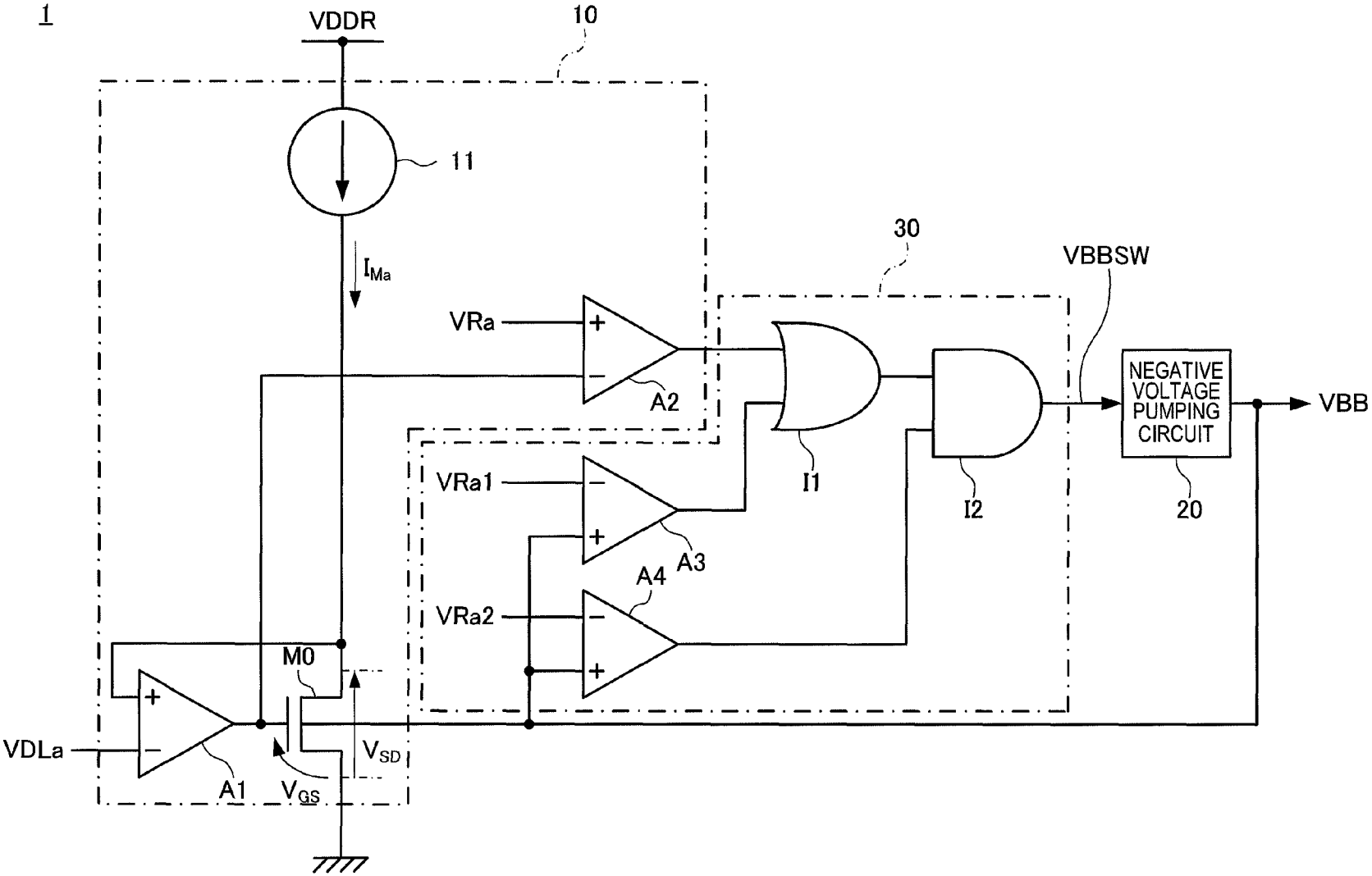
FIG. 1 is a circuit diagram of a semiconductor device according to a first embodiment of the present invention.

FIG. 1 is a circuit diagram of a semiconductor device 1 according to a first embodiment of the present invention.

As illustrated in FIG. 1, the semiconductor device 1 according to the first embodiment includes a monitoring circuit 10, a negative voltage pumping circuit (voltage generating circuit) 20, and a limiting circuit 30, and adjusts a threshold voltage of an N-channel MOS transistor that constitutes a sense amplifier.

In this case, before describing the individual circuits, the structure of a sense amplifier and a memory cell will be described.

Figure 2:
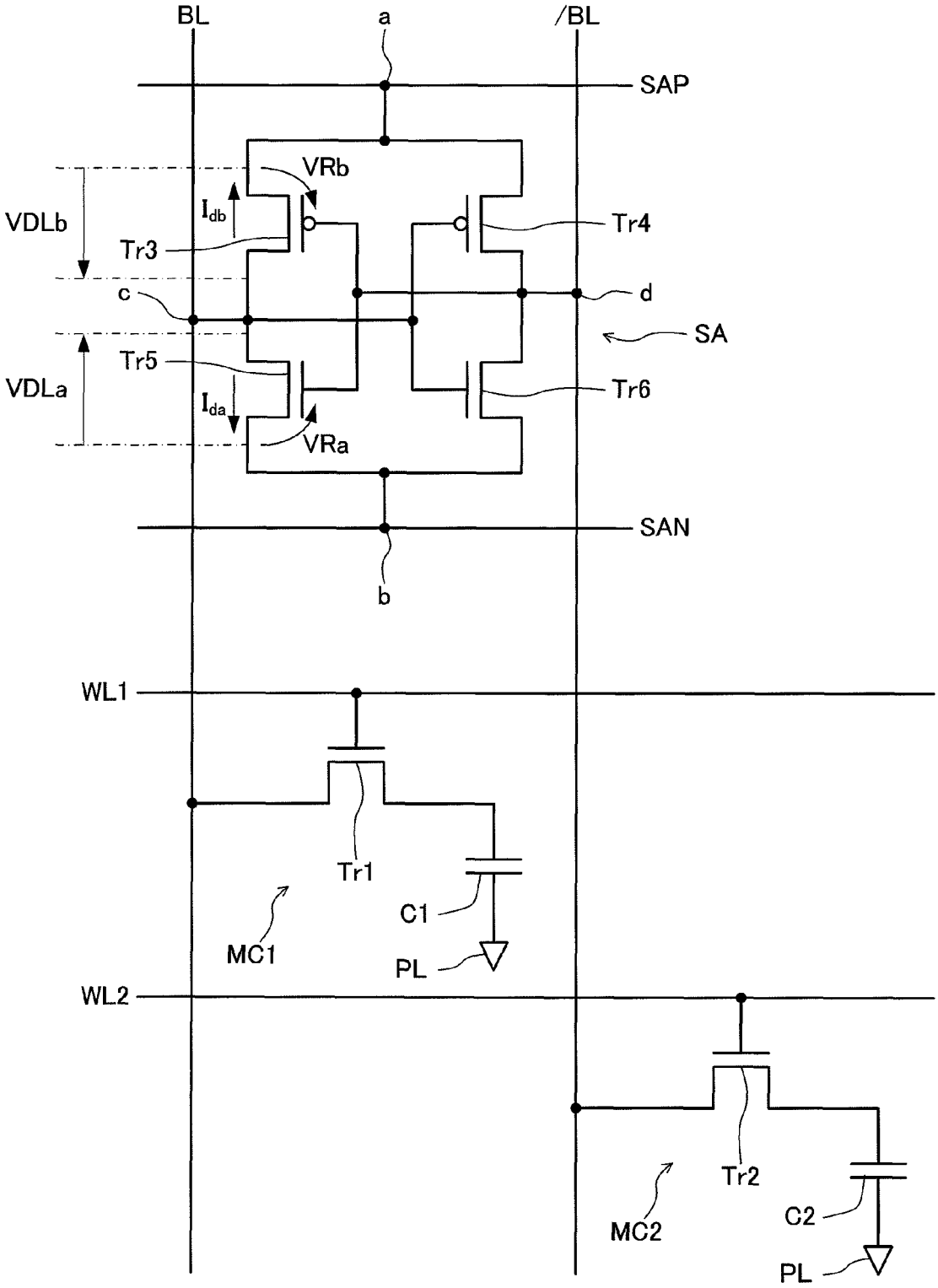
FIG. 2 is a circuit diagram of memory cells and a sensor amplifier.

FIG. 2 is a circuit diagram of the memory cell and the sensor amplifier. In FIG. 2, memory cells MC1 and MC2 that are connected to a pair of bit lines BL and /BL, respectively, and a sense amplifier SA are illustrated.

First, the memory cell MC1 is configured by an N-channel MOS transistor (cell transistor) Tr1 and a cell capacitor C1 serially connected between the bit line BL and a plate wiring line PL, and a gate electrode of the cell transistor Tr1 is connected to a corresponding word line WL1. By this configuration, if a level of the word line WL1 becomes a high level, the cell transistor Tr1 is turned on, and the cell capacitor C1 is connected to the bit line BL.

When data is written in the memory cell MC1, a high-potential-side write potential VARY (for example, 1.0 V) or a low-potential-side write potential VSSA (for example, 0 V) is supplied to the cell capacitor C1 according to data to be stored.

Meanwhile, when data is read out from the memory cell MC1, after the bit line BL is precharged with an intermediate potential, that is, (VARY−VSSA)/2, the cell transistor Tr1 is turned on. Thereby, when the high-potential-side write potential VARY is written in the cell capacitor C1, the potential of the bit line BL slightly increases from the intermediate potential. When the low-potential-side write potential VSSA is written in the cell capacitor C1, the potential of the bit line BL slightly decreases from the intermediate potential.

The memory cell MC2 is configured by an N-channel MOS transistor (cell transistor) Tr2 and a cell capacitor C2 serially connected between the bit line /BL and the plate wiring line PL, and a gate electrode of the cell transistor Tr2 is connected to a corresponding word line WL2. Since the operation of the memory cell MC2 is the same as the operation of the memory cell MC1, the description thereof is not repeated.

The sense amplifier SA is a circuit that controls driving of the bit lines BL and /BL, when data is written or read with respect to the memory cells MC1 and MC2. As illustrated in FIG. 2, the sense amplifier SA has four nodes, that is, a pair of power supply nodes a and b and a pair of signal nodes c and d. The power supply node a is connected to a high-potential-side driving wiring line SAP and the power supply node b is connected to a low-potential-side driving wiring line SAN. The signal nodes c and d are connected to the corresponding bit line pair BL and /BL. The sense amplifier SA is activated by supplying the high-potential-side write potential VARY and the low-potential-side write potential VSSA to the high-potential-side driving miring line SAP and the low-potential-side driving wiring line SAN, respectively.

The sense amplifier SA has P-channel MOS transistors Tr3 and Tr4 and N-channel MOS transistors Tr5 and Tr6. In the first embodiment, the threshold voltage of the N-channel MOS transistor Tr5 is to be adjusted.

The transistors Tr3 and Tr5 are serially connected between the power supply node a and the power supply node b, and a contact thereof is connected to one signal node c and gate electrodes thereof are connected to the other signal node d. In the same way, the transistors Tr4 and Tr6 are serially connected between the power supply node a and the power supply node b, and a contact thereof is connected to one signal node d and gate electrodes thereof are connected to the other signal node c.

When the data is written or read with respect to the memory cell MC1 or MC2, a potential difference is generated in the bit line pair BL and /BL. When the potential of the bit line BL becomes higher than the potential of the bar bit line /BL, the transistors Tr3 and Tr6 are turned on and the transistors Tr4 and Tr5 are turned off. Accordingly, the power supply node a and the signal node c are connected to each other, and the high-potential-side write potential VARY is supplied to the bit line BL. The power supply node b and the signal node d are connected to each other, and the low-potential-side write potential VSSA is supplied to the bar bit line /BL.

Meanwhile, when the potential of the bit line BL becomes lower than the potential of the bar bit line /BL, the transistors Tr4 and Tr5 are turned on and the transistors Tr3 and Tr6 are turned off. Accordingly, the power supply node a and the signal node d are connected to each other, and the high-potential-side write potential VARY is supplied to the bar bit line /BL. The power supply node b and the signal node c are connected to each other, and the low-potential-side write potential VSSA is supplied to the bit line BL.

Figure 3:
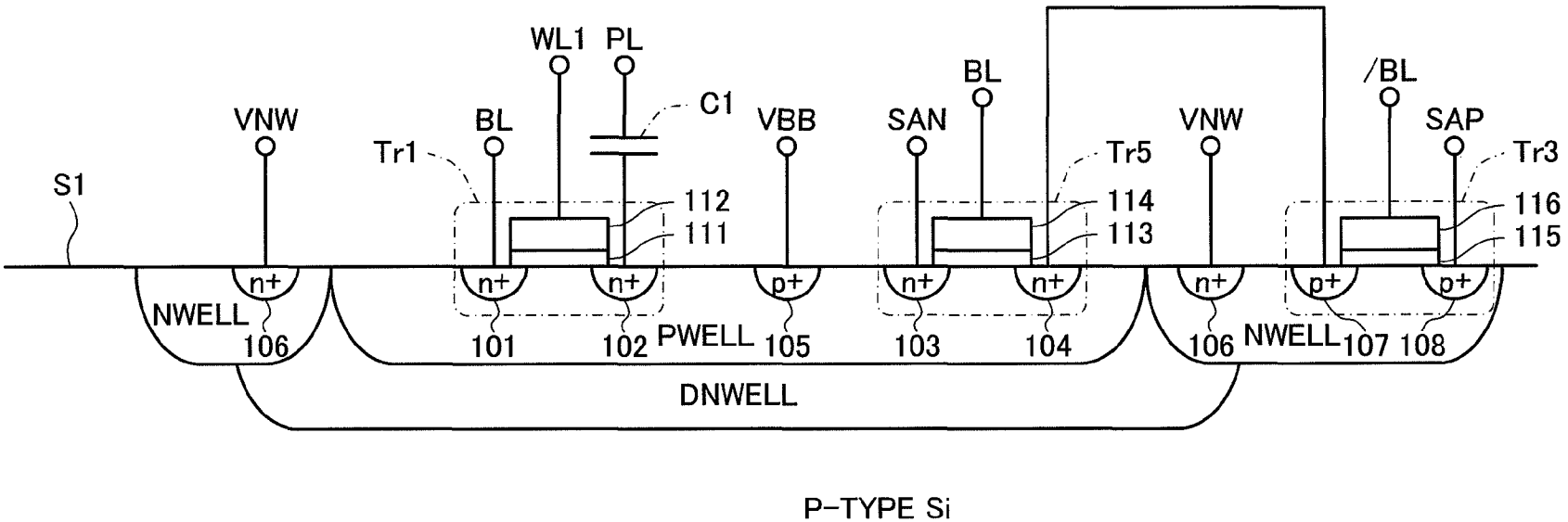
FIG. 3 is a schematic view of a cross-section of a memory cell and a sense amplifier.

FIG. 3 is a schematic view of a cross-section of the memory cell and the sense amplifier. In FIG. 3, a cross-section including the cell transistor Tr1, the P-channel MOS transistor. Tr3, and the N-channel MOS transistor Tr5 is illustrated.

As illustrated in FIG. 3, the transistors Tr1, Tr3, and Tr5 are formed on a substrate S1 that is a P-type silicon substrate. An N-type region DNWELL (Deep N-WELL) is formed near a surface of the substrate S1, and a P-type region PWELL is formed in a portion near the surface of the substrate S1 in the region DNWELL. The N-type regions NWELL are formed at both sides of the P-type region PWELL.

In a portion near the surface of the substrate S1 in the P-type region PWELL, n+ diffusion layers 101 to 104 and a p+ diffusion layer 105 are further provided. In the portion near the surface of the substrate S1 in the N-type region NWELL, an n+ diffusion layer 106 and p+ diffusion layers 107 and 108 are further provided.

On the surface of the substrate S1 between the n+ diffusion layer 101 and the n+ diffusion layer 102, a gate insulating film 111 made of dioxide silicon ($SiO_2$) and a gate electrode 112 made of polycrystalline silicon and polycide (compound of metal and polycrystalline silicon) or the metal are laminated in this order, and the cell transistor Tr1 that uses the n+ diffusion layers 101 and 102 as a source/drain region is configured. The gate electrode 112 is connected to the word line WL1. The n+ diffusion layer 101 and the n+ diffusion layer 102 are connected to the bit line BL and the cell capacitor C1, respectively.

On the surface of the substrate S1 between the n+ diffusion layer 103 and the n+ diffusion layer 104, a gate insulating film 113 made of dioxide silicon ($SiO_2$) and a gate electrode 114 made of polycrystalline silicon are laminated in this order, and the N-channel MOS transistor Tr5 that uses the n+ diffusion layers 103 and 104 as a source/drain region is configured. The gate electrode 114 is connected to the bit line BL. The n+ diffusion layer 103 and the n+ diffusion layer 104 are connected to the low-potential-side driving wiring line SAN and the p+ diffusion layer 107, respectively.

On the surface of the substrate S1 between the p+ diffusion layer 107 and the p+ diffusion layer 108, a gate insulating film 115 made of dioxide silicon ($SiO_2$) and a gate electrode 116 made of polycrystalline silicon are laminated in this order, and the P-channel MOS transistor Tr3 that uses the p+ diffusion layers 107 and 108 as a source/drain region is configured. The gate electrode 116 is connected to the bar bit line /BL. The p+ diffusion layer 108 and the p+ diffusion layer 107 are connected to the high-potential-side driving wiring line SAP and the n+ diffusion layer 104, respectively.

The p+ diffusion layer 105 is supplied with a substrate voltage VBB. The substrate voltage VBB becomes a substrate voltage that is common to the cell transistor Tr1 and the N-channel MOS transistor Tr5. Similarly, the n+ diffusion layer 106 is supplied with a substrate voltage VNW.

In this case, if the substrate voltage VBB becomes excessively high, a junction electric field of the n+ diffusion layer and the P-type region PWELL becomes stronger, and a PN junction leak increases in the cell transistor Tr1. In contrast, if the substrate voltage VBB becomes excessively low, a subthreshold leak of the cell transistor Tr1 increases. The limiting circuit 30 (refer to FIG. 1) according to the first embodiment is provided in view of the above circumferences and maintains the substrate voltage VBB in an appropriate range.

Figure 4:
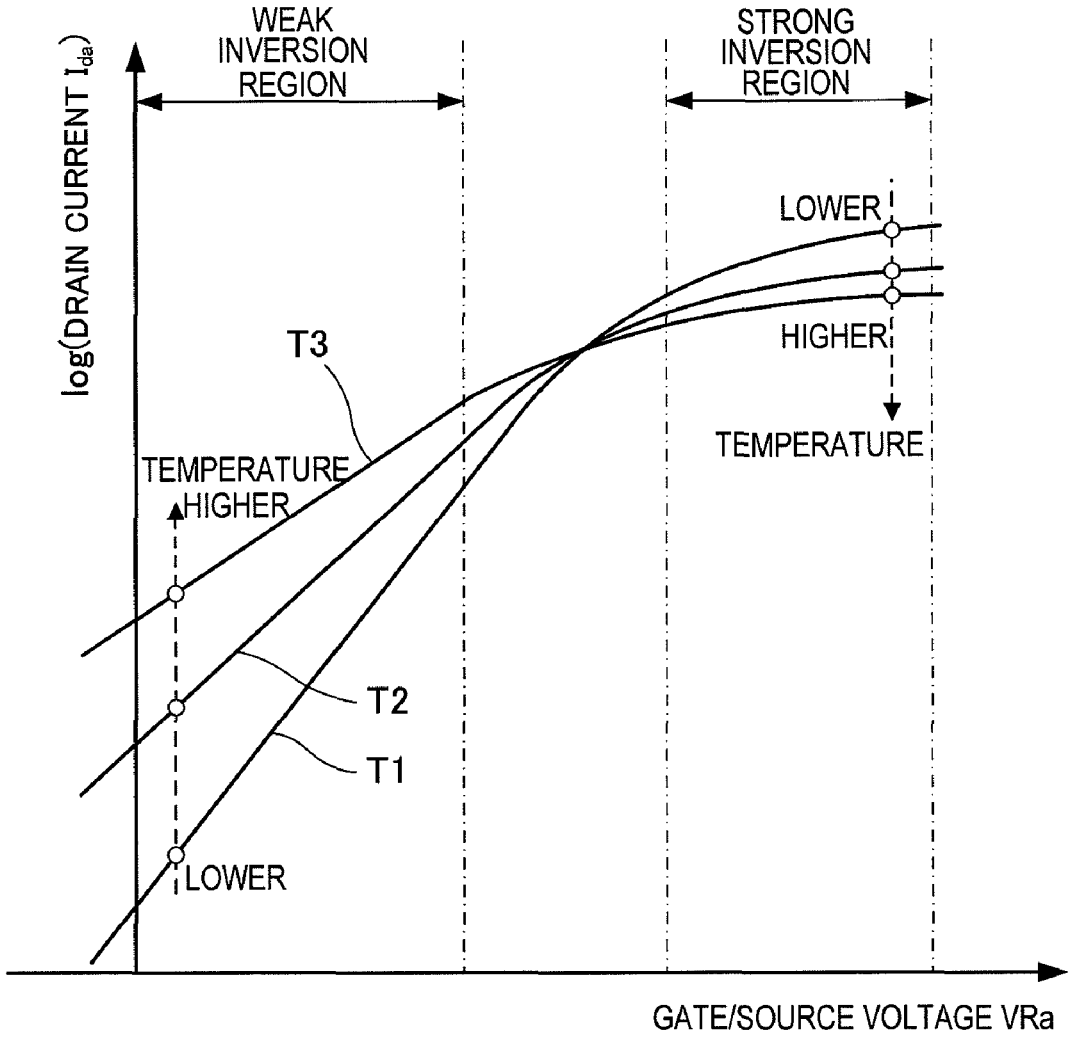
FIG. 4 illustrates a characteristic of a drain current $I_{da}$ of a N-channel MOS transistor with respect to a gate/source voltage VRa.

FIG. 4 illustrates a characteristic of a drain current $I_{da}$ (refer to FIG. 2) of the N-channel MOS transistor Tr5 with respect to a gate/source voltage VRa (refer to FIG. 2). A vertical axis indicates a logarithmic axis. A "weak inversion region" illustrated in FIG. 4 indicates a range of a gate/source voltage VRa where the transistor Tr5 is turned off, and a "strong inversion region" indicates a range of the gate/source voltage VRa where the transistor Tr5 is turned on. As illustrated in FIG. 4, even in a state where the transistor Tr5 is turned off, a small drain current $I_{da}$ flows. This current is a so-called subthreshold leak current.

The characteristic of the gate/source voltage VRa with respect to the drain current $I_{da}$ is different depending on the temperature. In FIG. 4, characteristics that correspond to three temperatures T1, T2, and T3 (T1<T2<T3) are illustrated. As can be seen from the characteristics, in "the weak inversion region", the higher the temperature is, the greater the drain current $I_{da}$ becomes. In contrast, in "the strong inversion region", the higher the temperature is, the smaller the drain current $I_{da}$ becomes. That is, the drain current $I_{da}$ has a positive temperature characteristic in the "weak inversion region", but has a negative temperature characteristic in the "strong inversion region". The monitoring circuit 10 compensates for temperature dependency of the characteristic of the gate/source voltage VRa with respect to the drain current $I_{da}$, so as to obtain almost the constant characteristic of the gate/source voltage VRa without depending on the temperature.

Referring back to FIG. 1, the individual circuits that constitute the semiconductor device 1 will be described.

The monitoring circuit 10 has an N-channel MOS transistor M0, an operational amplifier A1, a comparator A2, and a constant current source 11, and monitors a gate/source voltage $V_{GS}$ that is needed when the N-channel MOS transistor M0 flows a current $I_{Ma}$ having a given designed value. The transistor M0 is a replica transistor of the N-channel MOS transistor Tr5 whose threshold voltage is to be adjusted in the first embodiment. The replica means that the transistor and the replica transistor have the same impurity profile, the same W/L ratio, and gate insulating films having the same thickness, and are formed on the same substrate or a substrate having the same impurity concentration.

A drain of the transistor M0 is connected to the constant current source 11 and a non-inverting input terminal of the operational amplifier A1 and is supplied with the current $I_{Ma}$ from the constant current source 11. A source of the transistor M0 is connected to a ground, and a gate thereof is connected to an output terminal of the operational amplifier A1 and an inverting input terminal of the comparator A2. An inverting input terminal of the operational amplifier A1 is supplied with a voltage VXa and a non-inverting input terminal of the comparator A2 is supplied with a voltage VYa.

The high-potential-side write potential VARY is used as the voltage VXa, which will be described in detail below.

First, an object of the monitoring when the gate/source voltage VRa is in the "weak inversion region" is to decrease an inter-chip variation of a leak current that flows through the sense amplifier SA after the operation of the sense amplifier SA is completed. Since the magnitude of the leak current significantly depends on the source/drain voltage, the source/drain voltage of the transistor M0 needs to be equalized to a source/drain voltage VDLa (refer to FIG. 2) of the transistor Tr5.

In this case, when the gate/source voltage VRa is in the "weak inversion region", the source/drain voltage VDLa of the transistor Tr5 is equalized to the high-potential-side write potential VARY. When the transistor Tr5 is turned off, the transistor Tr1 is turned on. As apparent from FIG. 2, the drain of the transistor Tr5 is connected to the high-potential-side driving wiring line SAP. Accordingly, if the high-potential-side write potential VARY is used as the voltage VXa, due to a virtual short circuit of the operational amplifier A1, the source/drain voltage of the transistor M0 is equalized to the source/drain voltage VDLa of the transistor Tr5.

Meanwhile, an object of the monitoring when the gate/source voltage VRa is in the "strong inversion region" is to decrease an inter-chip variation of an operation speed. That is, the object of the monitoring is to equalize a maximum current at the moment of the transistor being turned on. Since the monitoring becomes monitoring in a state where a drain current is almost saturated, the drain current does not depend on the source/drain voltage. Accordingly, the source/drain voltage of the transistor M0 does not need to be equalized to the source/drain voltage VDLa of the transistor Tr5. Meanwhile, if the source/drain voltage of the transistor M0 becomes 0 V, the first drain current does not flow. Accordingly, in order to monitor a state where a large drain current flows, the voltage VXa is used as the high-potential-side write potential VARY, as described above.

When the gate/source voltage VRa is in the "strong inversion region", the gate/source voltage VRa of the transistor Tr5 is equalized to the high-potential-side write potential VARY. When the transistor Tr5 is turned on, the transistor Tr4 is also turned on. As apparent from FIG. 2, the gate of the transistor Tr5 is connected to the high-potential-side driving wiring line SAP.

The gate/source voltage VRa of the transistor Tr5 is used as the voltage VYa, but the voltage VRa may not be used. A specific value of the voltage VYa may be individually determined when the gate/source voltage VRa is in the "weak inversion region" or the "strong inversion region".

The monitoring circuit 10 may monitor both the case where the gate/source voltage VRa is in the "weak inversion region" and the case where the gate/source voltage VRa is in the "strong inversion region", or monitor only one of the above cases. When the monitoring circuit 10 monitors both cases, in addition to the voltage VYa, an output current $I_{Ma}$ (to be described in detail below) of the constant current source 11 needs to be switchable. Specifically, a switch that switches these values according to the gate/source voltage VRa may be provided. Alternatively, a first monitoring circuit 10 where the voltage VYa and the output current $I_{Ma}$ for the "weak inversion region" are set in advance and a second monitoring circuit 10 where the voltage VYa and the output current $I_{Ma}$ for the "strong inversion region" are set in advance may be prepared, and connection of the monitoring circuits 10 and the limiting circuit 30 may be switched according to the gate/source voltage VRa.

Figure 5:
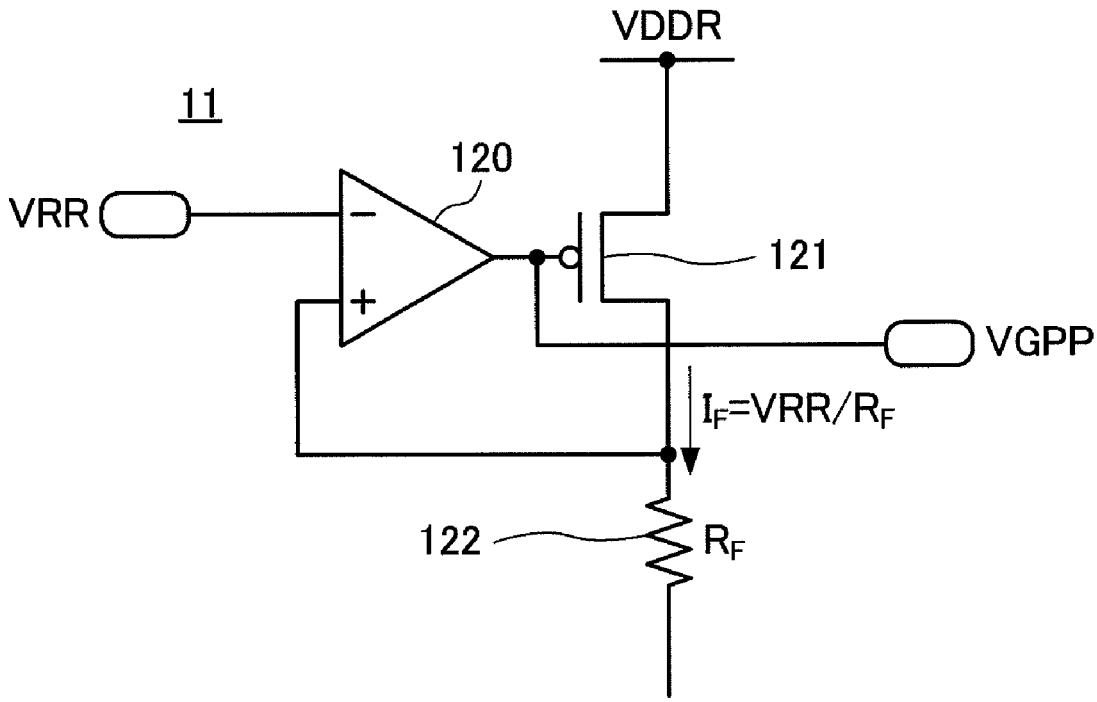
FIG. 5 is an internal circuit diagram of a constant current source.

FIG. 5 is an internal circuit diagram of the constant current source 11. As illustrated in FIG. 5, the constant current source 11 has an operational amplifier 120, P-channel MOS transistors 121 and 123, and a resistor 122 having a resistance value $R_F$. The transistor 121 has a source that is supplied with a power supply voltage VDDR and a drain that is connected to the resistor 122 and a non-inverting input terminal of the operational amplifier 120. Gates of the transistors 121 and 123 are connected to an output terminal of the operational amplifier 120. An inverting input terminal of the operational amplifier 120 is supplied with a voltage VRR.

By this configuration, a current $I_F$ that flows through the resistor 122 having the resistance value $R_F$ is represented by $I_F$=VRR/$R_F$. Accordingly, the current $I_F$ can be adjusted by adjusting the voltage VRR and the resistance value $R_F$. If sizes of the transistors 121 and 123 are equalized, the output current $I_{Ma}$ is equalized to the current $I_F$.

Figure 6:
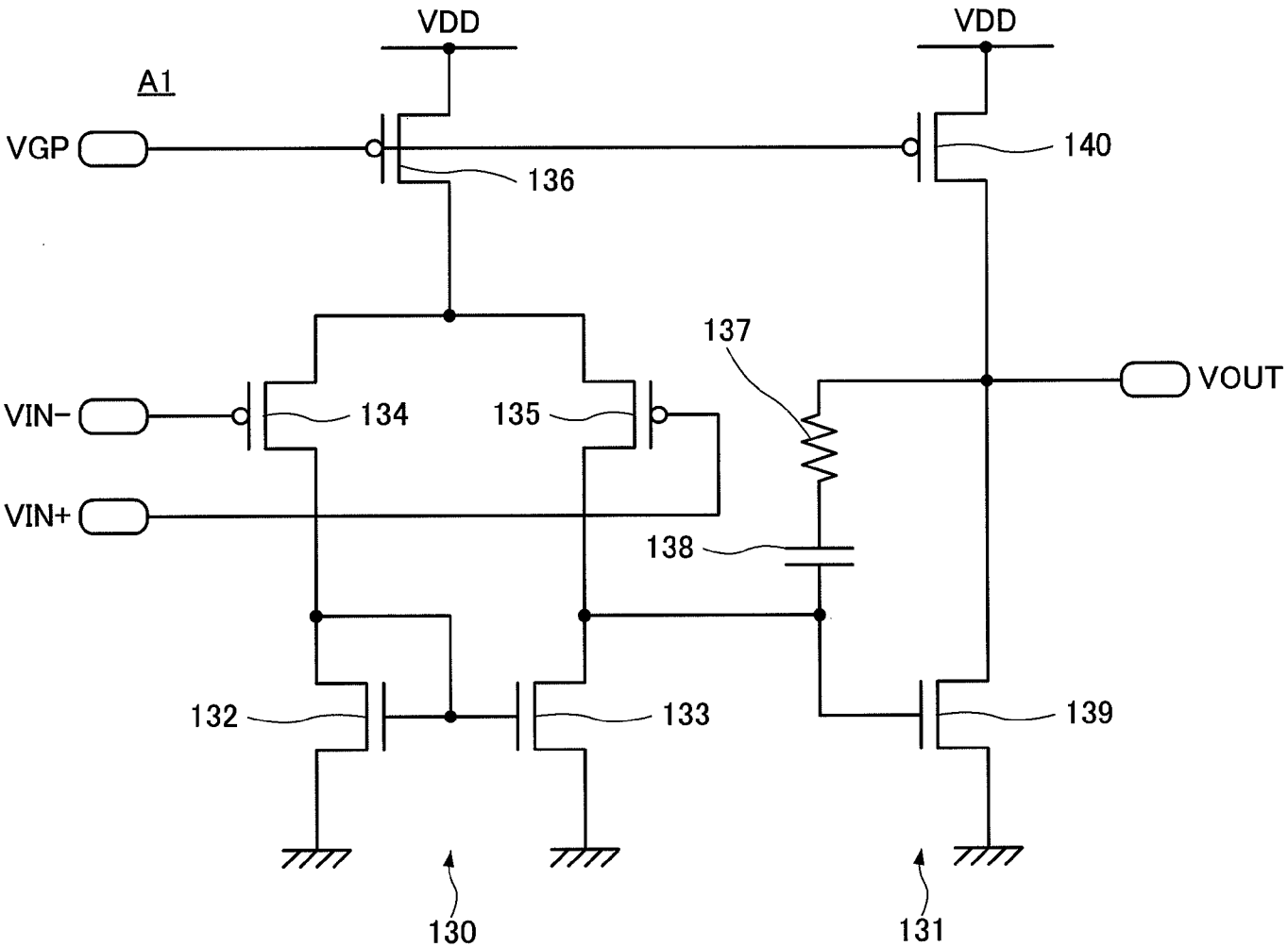
FIG. 6 is an internal circuit diagram of an operational amplifier.

FIG. 6 is an internal circuit diagram of the operational amplifier A1. As illustrated in FIG. 6, the operational amplifier A1 includes a differential amplifying circuit 130 and an output circuit 131 that are cascade connected. That is, an input VIN− of an inverting input terminal and an input VIN+ of a non-inverting input terminal are first supplied to the differential amplifying circuit 130, and an output of the differential amplifying circuit 130 is supplied to the output circuit 131. An output of the output circuit 131 becomes an output VOUT of an output terminal.

The differential amplifying circuit 130 includes N-channel MOS transistors 132 and 133 that are connected in a current mirror manner, P-channel MOS transistors 134 and 135 that are connected in series to the N-channel MOS transistors 132 and 133, and a P-channel MOS transistor 136 that is connected to sources of the P-channel MOS transistors 134 and 135. Sources of the transistors 132 and 133 are connected to a ground. A source of the transistor 136 is supplied with a power supply voltage VDD and a gate thereof is supplied with a voltage VGP. A gate of the transistor 134 receives the input VIN− of the inverting input terminal and a gate of the transistor 135 receives the input VIN+ of the non-inverting input terminal. An output of the differential amplifying circuit 130 is extracted from a connection point of the transistor 135 and the transistor 133.

The output circuit 131 includes an N-channel MOS transistor 139 whose gate is supplied with the output of the differential amplifying circuit 130, a P-channel MOS transistor 140 that is connected to a drain of the N-channel MOS transistor 139, a phase compensating capacitor 138 and a resistor 137 that are connected in series between a gate and a drain of the N-channel MOS transistor 139. A source of the transistor 139 is connected to a ground. A source of the transistor 140 is supplied with the power supply voltage VDD and a gate thereof is supplied with the voltage VGP. The output of the output circuit 131 is extracted from the drain of the transistor 139, and becomes an output VOUT of the operational amplifier A1.

In the example of FIG. 6, a so-called pMOS input-type differential amplifying circuit where the transistors 134 and 135 are configured as the P-channel MOS transistors is used. However, a so-called nMOS input-type differential amplifying circuit where the transistors 134 and 135 are configured as the N-channel MOS transistors may be used as the differential amplifying circuit 130. The type of the differential amplifying circuit 130 to be used may be determined according to the magnitude of VIN+. That is, in the case of VDD/2>VIN+>VSS, a pMOS input-type operational amplifier is preferably used as the differential amplifying circuit 130. Meanwhile, in the case of VDD>VIN+>VDD/2, an nMOS input-type operational amplifier is preferably used as the differential amplifying circuit 130.

Figure 7:
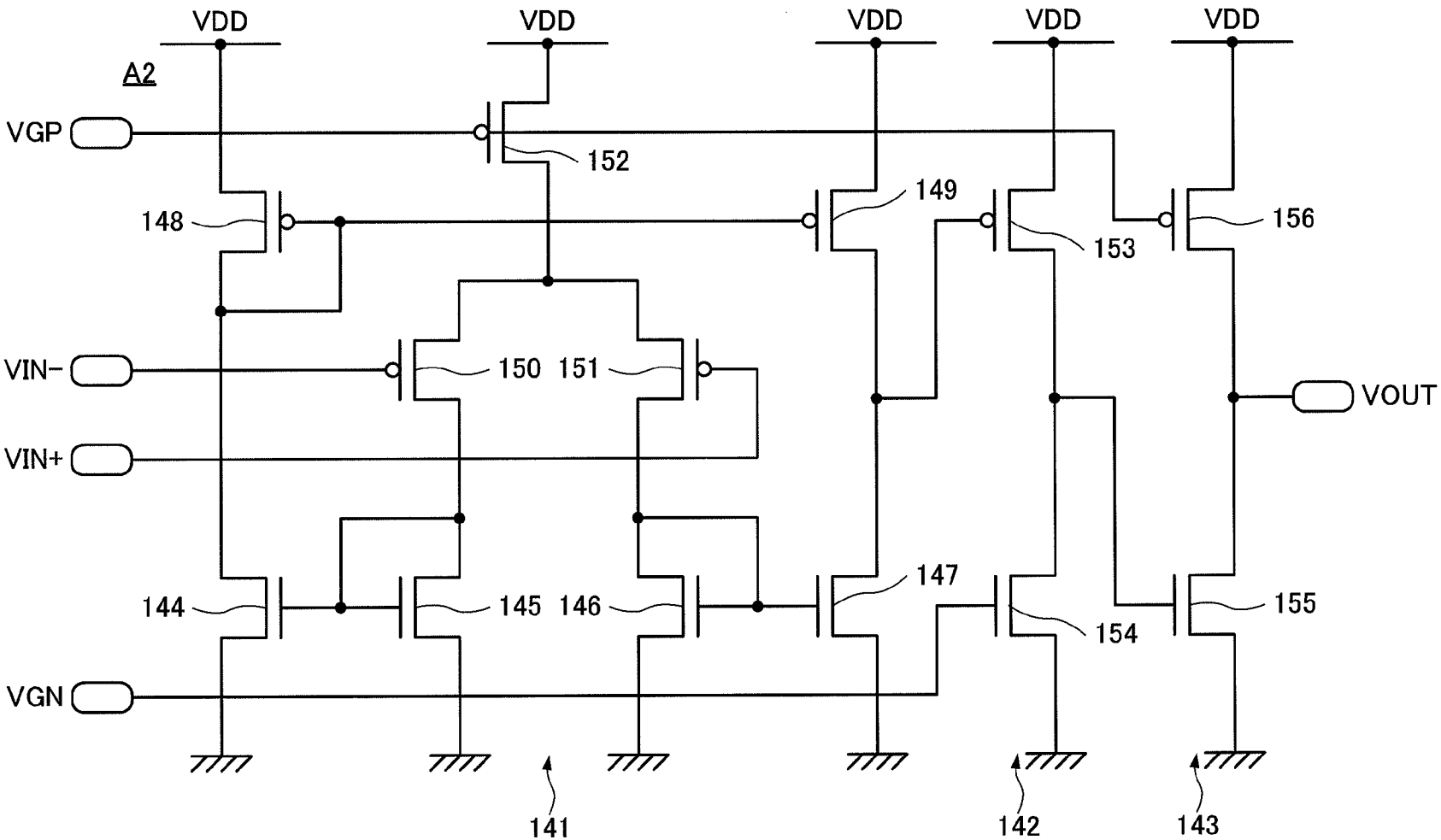
FIG. 7 is an internal circuit diagram of the comparator.

FIG. 7 is an internal circuit diagram of the comparator A2. As illustrated in FIG. 6, the comparator A2 has a differential amplifying circuit 141, an amplifying circuit 142, and an output circuit 143 that are cascade connected. That is, an input VIN− of an inverting input terminal and an input VIN+ of a non-inverting input terminal are first supplied to the differential amplifying circuit 141, and an output of the differential amplifying circuit 141 is supplied to the amplifying circuit 142. An output of the amplifying circuit 142 is supplied to the output circuit 143, and an output of the output circuit 143 becomes an output VOUT of an output terminal.

The differential amplifying circuit 141 includes N-channel MOS transistors 144 and 145, N-channel MOS transistors 146 and 147, and P-channel MOS transistors 148 and 149 that are connected in a current mirror manner, respectively, P-channel MOS transistors 150 and 151 that are connected in series to the N-channel MOS transistors 145 and 146, and a P-channel MOS transistor 152 that is connected to sources of the P-channel MOS transistors 150 and 151. Drains of the transistors 144, 148 and drains of the transistors 147, 149 are connected to each other, respectively, and sources of the transistors 144 to 147 are connected to a ground. Sources of the transistors 148 and 149 are supplied with the power supply voltage VDD. A source of the transistor 148 is supplied with the power supply voltage VDD and a gate thereof is supplied with the voltage VGP. A gate of the transistor 150 receives the input VIN− of the inverting input terminal and a gate of the transistor 151 receives the input VIN+ of the non-inverting input terminal. An output of the differential amplifying circuit 141 is extracted from a connection point of the transistor 147 and the transistor 149.

The amplifying circuit 142 includes a P-channel MOS transistor 153 whose gate is supplied with the output of the differential amplifying circuit 141, and an N-channel MOS transistor 154 that is connected to a drain of the P-channel MOS transistor 153. A source of the transistor 153 is supplied with the power supply voltage VDD. A source of the transistor 154 is connected to a ground and a gate thereof is supplied with a voltage VGN. An output of the amplifying circuit 142 is extracted from the drain of the transistor 153.

The output circuit 143 includes an N-channel MOS transistor 155 whose gate is supplied with the output of the amplifying circuit 142, and a P-channel MOS transistor 156 that is connected to a drain of the N-channel MOS transistor 155. A source of the transistor 155 is connected to a ground. A source of the transistor 156 is supplied with the power supply voltage VDD and a gate thereof is supplied with a voltage VGP. An output of the output circuit 143 is extracted from the drain of the transistor 156, and becomes an output VOUT of the comparator A2.

In the example of FIG. 7, a so-called pMOS input-type differential amplifying circuit where the transistors 150 and 151 are configured as the P-channel MOS transistors is used. However, a so-called nMOS input-type differential amplifying circuit where the transistors 150 and 151 are configured as the N-channel MOS transistors may be used as the differential amplifying circuit 141. The type of the differential amplifying circuit 141 to be used may be determined according to the magnitude of VIN+. That is, in the case of VDD/2>VIN+>VSS, the pMOS input-type differential amplifying circuit is preferably used as the differential amplifying circuit 141. Meanwhile, in the case of VDD>VIN+>VDD/2, the nMOS input-type differential amplifying circuit is preferably used as the differential amplifying circuit 141.

Referring back to FIG. 1, the operation of the monitoring circuit 10 will be described. The non-inverting input terminal of the operational amplifier A1 is supplied with a source/drain voltage $V_{SD}$ of the transistor M0. Accordingly, due to a virtual short circuit of the operational amplifier A1, the source/drain voltage $V_{SD}$ of the transistor M0 is equalized to a voltage Vxa that is supplied to the inverting input terminal of the operational amplifier A1.

The drain of the transistor M0 is supplied with the current $I_{Ma}$ from the constant current source 11. The current $I_{Ma}$ is a designed value of the drain current $I_{da}$ of the transistor Tr5. By adjusting the voltage VRR and the resistance value $R_F$ of the constant current source 11 (refer to FIG. 5), the value of the current $I_F$ that is output by the constant current source 11 is set as the current $I_{Ma}$ in advance. A specific value of the current $I_{Ma}$ may be individually determined when the gate/source voltage VRa is in the "weak inversion region" or the "strong inversion region".

As described above, since the drain current and the source/drain voltage $V_{SD}$ of the transistor M0 are provided, the gate/source voltage $V_{GS}$ of the transistor M0 is determined. However, a value of the gate/source voltage $V_{GS}$ determined in the above way is different depending on a value of the substrate voltage VBB of the transistor M0. This is due to a substrate bias effect. That is, between the threshold voltage of the N-channel MOS transistor and the substrate potential, there is a relationship that the lower the substrate potential is, the higher the threshold voltage becomes. Therefore, the lower the substrate voltage VBB is, the greater the gate/source voltage $V_{GS}$ that is needed to flow a drain current equal to the current $I_{MA}$ becomes.

The inverting input terminal of the comparator A2 is supplied with the voltage $V_{GS}$. As described above, the non-inverting input terminal of the comparator A2 is supplied with the gate/source voltage VRa of the transistor Tr5. Accordingly, the comparator A2 compares the gate/source voltage $V_{GS}$ of the transistor M0 and the gate/source voltage VRa of the transistor Tr5. As a comparison result, when the voltage $V_{GS}$ is lower than the voltage VRa, the comparator A2 outputs a high-level signal, and when the voltage $V_{GS}$ is not lower than the voltage VRa, the comparator A2 outputs a low-level signal.

Next, the negative voltage pumping circuit 20 is a circuit that can generate a voltage of about −VDD, and the generated voltage becomes the substrate voltage VBB. The negative voltage pumping circuit 20 starts to generate the substrate voltage VBB, when a level of an input voltage VBBSW becomes a high level. When the negative voltage pumping circuit 20 generates the substrate voltage VBB, the substrate voltage VBB gradually decreases and finally becomes a predetermined value. When the level of the input voltage VBBSW becomes a low level, the negative voltage pumping circuit 20 stops generation of the substrate voltage VBB. When the negative voltage pumping circuit 20 stops the generation of the substrate voltage VBB, the substrate voltage VBB gradually increases due to the substrate current, such as a junction leak, and a level thereof finally becomes a ground level.

The limiting circuit 30 defines the operation of the negative voltage pumping circuit 20, regardless of the monitoring result of the gate/source voltage $V_{GS}$ of the transistor M0, in response to an excess of the substrate voltage VBB with respect to the predetermined value. By this configuration, the limiting circuit 30 can maintain the substrate voltage VBB in an appropriate range.

As illustrated in FIG. 1, the limiting circuit 30 has comparators A3 and A4, an OR circuit I1, and an AND circuit I2. A non-inverting input terminal of each of the comparators A3 and A4 is supplied with the substrate voltage VBB. Meanwhile, an inverting input terminal of the comparator A3 is supplied with a voltage VRa1 corresponding to an upper limit of the substrate voltage VBB, and an inverting input terminal of the comparator A4 is supplied with a voltage VRa2 corresponding to a lower limit of the substrate voltage VBB. An internal circuit of each of the comparators A3 and A4 is the same as that of the comparator A2 illustrated in FIG. 7. When the input voltage of the non-inverting input terminal is higher than the input voltage of the inverting input terminal, a high-level signal is output, and when the input voltage of the non-inverting input terminal is not higher than the input voltage of the inverting input terminal, a low-level signal is output.

The OR circuit I1 is connected to an output terminal of each of the comparators A2 and A3. In the case where outputs of the comparators A2 and A3 are at low levels, the OR circuit I1 outputs a low-level signal. In the other cases, the OR circuit I1 outputs a high-level signal. The AND circuit I2 is connected to an output terminal of the OR circuit I1 and an output terminal of the comparator A4. In the case where outputs of the OR circuit I1 and the comparator A4 are at high levels, the AND circuit I2 outputs a high-level signal. In the other cases, the AND circuit I2 outputs a low-level signal. An output of the AND circuit I2 is input as the input voltage VBBSW to the negative voltage pumping circuit 20.

Table 1 illustrates a correspondence relationship between the output of each of the comparators A2 to A4, the OR circuit I1, and the AND circuit I2, and a control direction of the substrate voltage VBB and a variation direction of the threshold voltage of the transistor Tr5.

TABLE 1

| | A2 | A3 | I1 | A4 | VBBSW | VBB | THRESHOLD VOLTAGE |
|---|---|---|---|---|---|---|---|
| 1 | H | H | H | H | H | DOWN | UP |
| 2 | | | | L | L | UP | DOWN |
| 3 | | L | | H | H | DOWN | UP |
| 4 | | | | L | L | UP | DOWN |
| 5 | L | H | | H | H | DOWN | UP |
| 6 | | | | L | L | UP | DOWN |
| 7 | | L | L | H | L | UP | DOWN |
| 8 | | | | L | L | UP | DOWN |

As can be seen from Table 1, when the output of the comparator A3 is at a high level, that is, the substrate voltage VBB is higher than the voltage VRa1, a level of the input voltage VBBSW becomes a high level without depending on the output of the comparator A2 (first and fourth patterns of Table 1. Second and sixth patterns that are displayed with a gray color are not actually realized). That is, when the substrate voltage VBB is higher than the voltage VRa1, the limiting circuit 30 activates the negative voltage pumping circuit 20, regardless of the monitoring result of the gate/source voltage $V_{GS}$. Accordingly, the substrate voltage VBB does not increase longer.

When the output of the comparator A4 is at a low level, that is, the substrate voltage VBB is lower than the voltage VRa2, a level of the input voltage VBBSW becomes a low level without depending on the output of the comparator A2 (fourth and eighth patterns of Table 1). That is, when the substrate voltage VBB is lower than the voltage VRa2, the limiting circuit 30 inactivates the negative voltage pumping circuit 20, regardless of the monitoring result of the gate/source voltage $V_{GS}$. Accordingly, the substrate voltage VBB does not decrease longer.

Meanwhile, when the output of the comparator A3 is at a low level and the output of the comparator A4 is at a high level, that is, the substrate voltage VBB is in a range between the voltage VRa1 and the voltage VRa2, the input voltage VBBSW is equalized to the output of the comparator A2 (third and seventh patterns of Table 1). Accordingly, when the gate/source voltage $V_{GS}$ of the transistor M0 is lower than the gate/source voltage VRa of the transistor Tr5 (when the output of the comparator A2 is at a high level), the negative voltage pumping circuit 20 is activated, the threshold voltage of the transistor Tr5 increases, and the drain current $I_{da}$ decreases. Meanwhile, when the voltage $V_{GS}$ is higher than the voltage VRa (when the output of the comparator A2 is at a low level), the negative voltage pumping circuit 20 is inactivated, the threshold voltage of the transistor Tr5 decreases, and the drain current $I_{da}$ increases.

Figure 8A:
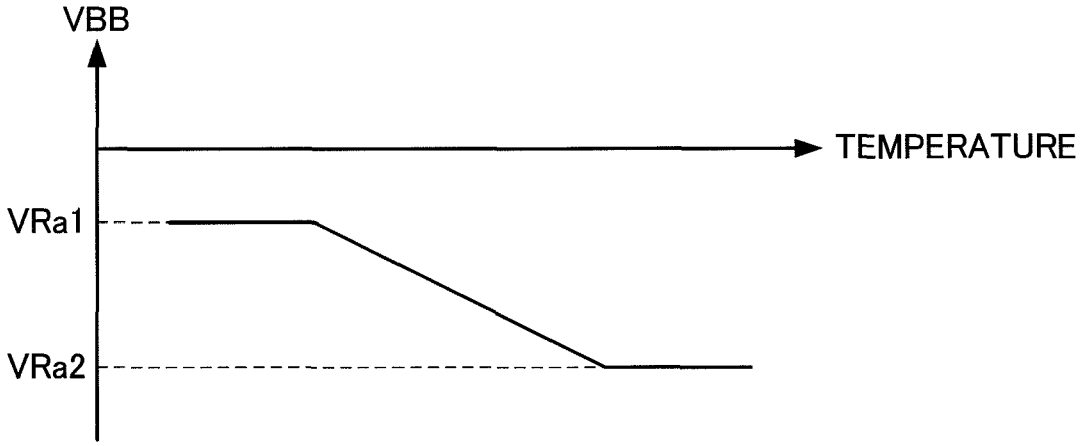
FIG. 8A is a graph illustrating a temperature variation of a substrate voltage VBB that is realized by processes of a monitoring circuit and a limiting circuit according to the first embodiment of the present invention, when the gate/source voltage of the transistor whose threshold voltage is to be adjusted is in the "weak inversion region"

FIG. 8A is a graph illustrating a temperature variation of the substrate voltage VBB that is realized by processes of the monitoring circuit 10 and the limiting circuit 30, when the gate/source voltage VRa of the transistor Tr5 is in the "weak inversion region". As illustrated in FIG. 8A, in the "weak inversion region", when the substrate voltage VBB is in a range between the voltage VRa1 and the voltage VRa2, if the temperature increases, the substrate voltage VBB decreases. This corresponds to the case where the drain current Ida increases, if the temperature is higher in the "weak inversion region" (drain current $I_{da}$ has a positive temperature characteristic), as illustrated in FIG. 4. That is, the higher the temperature is, the higher the drain current $I_{da}$ becomes. Therefore, the monitoring circuit 10 increases the threshold voltage of the transistor Tr5, that is, decreases the substrate voltage VBB, and decreases the drain current $I_{da}$.

Figure 8B:
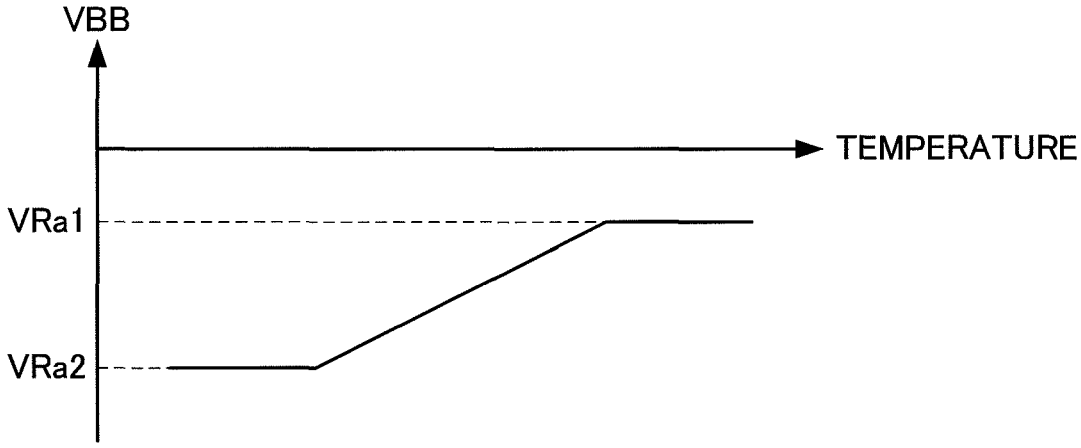
FIG. 8B is a graph illustrating a temperature variation of a substrate voltage VBB that is realized by processes of a monitoring circuit and a limiting circuit according to the first embodiment of the present invention, when the gate/source voltage of the transistor whose threshold voltage is to be adjusted is in the "strong inversion region"

FIG. 8B is a graph illustrating a temperature variation of the substrate voltage VBB that is realized by processes of the monitoring circuit 10 and the limiting circuit 30, when the gate/source voltage VRa of the transistor Tr5 is in the "strong inversion region". As illustrated in FIG. 8B, in the "strong inversion region", when the substrate voltage VBB is in a range between the voltage VRa1 and the voltage VRa2, if the temperature increases, the substrate voltage VBB also increases. This corresponds to the case where the drain current $I_{da}$ decreases, if the temperature is higher in the "strong inversion region" (drain current $I_{da}$ has a negative temperature characteristic), as illustrated in FIG. 4. That is, the higher the temperature is, the higher the drain current $I_{da}$ becomes. Therefore, the monitoring circuit 10 decreases the threshold voltage of the transistor Tr5, that is, increases the substrate voltage VBB, and increases the drain current $I_{da}$.

Meanwhile, as illustrated in FIGS. 8A and 8B, the substrate voltage VBB does not become equal to or higher than the voltage VRa1 or lower than or equal to the voltage VRa2. This is realized by a function of the limiting circuit 30. As a result, the substrate voltage VBB can be maintained in an appropriate range. That is, a characteristic of another transistor (for example, cell transistor Tr1 (refer to FIG. 3)) that is in the same PWELL region as the transistor Tr5 can be prevented from being deteriorated due to the process of the monitoring circuit 10. Specifically, the charge of the cell capacitor C1 can be prevented from being lost due to the subthreshold leak caused by an excessive increase in the leak current of the cell transistor Tr1, or the charge of the cell capacitor C1 can be prevented from being lost due to the junction leak generated in a boundary portion of the substrate with respect to the diffusion layer in the cell transistor Tr1.

As described above, according to the semiconductor device 1, the substrate voltage VBB can be maintained in an appropriate range while the substrate voltage VBB is controlled to adjust the threshold voltage of the transistor Tr5.

In this case, various modifications of the first embodiment are considered. Hereinafter, first to fourth modifications of the first embodiment will be described. However, before specifically describing each modification, the outline of each modification is described.

In each of the first and second modifications, only the upper limit or the lower limit of the substrate voltage VBB is set. Both the upper limit and the lower limit of the substrate voltage VBB may not be set according to the specification of the cell transistor Tr1 etc. The first and second modifications correspond to the case where only the upper limit or the lower limit of the substrate voltage VBB is set.

In the third and fourth modifications, a variation in the adjustment result of the threshold voltage of the transistor Tr5 is suppressed. That is, in the first embodiment, the channel width W and the channel length L of the transistor Tr5 whose threshold voltage is to be adjusted are significantly smaller than those used in a peripheral circuit generally. For example, the channel width W is 1 um and the channel length L is 0.1 um. If the channel width W and the channel length L of the transistor Tr5 are small like this, due to a statistical variation of the concentration when an impurity is implanted between the transistor Tr5 whose threshold voltage is to be adjusted and the replica transistor M0, a mismatch of the threshold voltage increases. That is, the probability of the substrate voltage VBB being shifted from an optimal value increases due to an increase in the variation in the substrate voltage VBB. In the third and fourth modifications, the variation can be suppressed.

Figure 9:
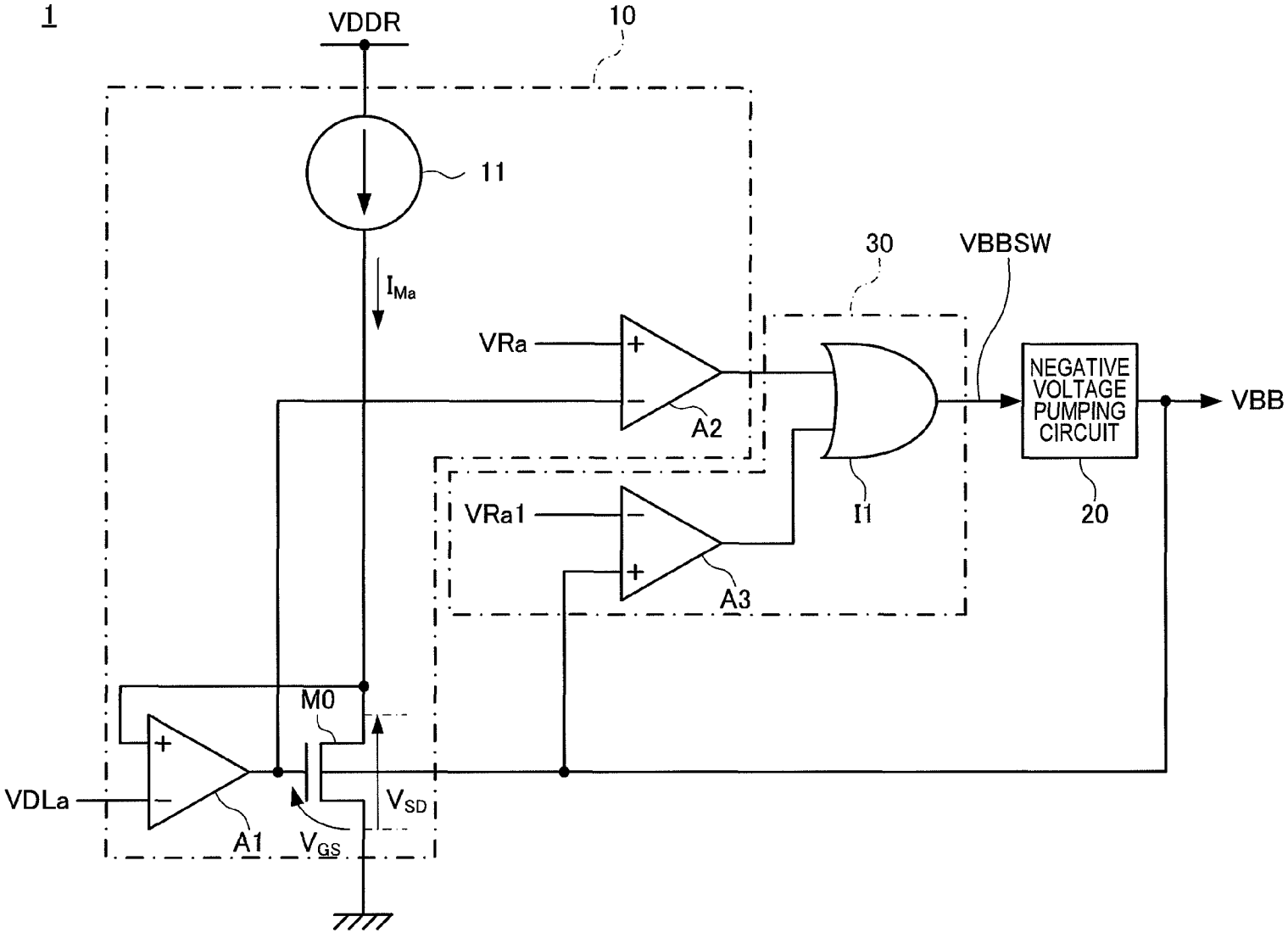
FIG. 9 is a circuit diagram of a semiconductor device according to a first modification of the first embodiment of the present invention.

The various modifications will be sequentially described from the first modification. FIG. 9 is a circuit diagram of a semiconductor device 1 according to the first modification. In the first modification, since the internal configuration of the limiting circuit 30 is different from the internal configuration of the circuit diagram of FIG. 1, the different configuration of the limiting circuit 30 will be mainly described.

As illustrated in FIG. 9, the limiting circuit 30 according to the first modification has the comparator A3 and the OR circuit I1, but does not have the comparator A4 and the AND circuit I2. The output of the OR circuit I1 is directly input as the input voltage VBBSW to the negative voltage pumping circuit 20.

Table 2 illustrates a correspondence relationship between the output of each of the comparators A2 and A3 and the AND circuit I2, and a control direction of the substrate voltage VBB and a variation direction of the threshold voltage of the transistor Tr5.

TABLE 2

| | A2 | A3 | VBBSW | VBB | THRESHOLD VOLTAGE |
|---|---|---|---|---|---|
| 1 | H | H | H | DOWN | UP |
| 2 | | L | H | DOWN | UP |
| 3 | L | H | H | DOWN | UP |
| 4 | | L | L | UP | DOWN |

As can be seen from Table 2, when the output of the comparator A3 is at a high level, that is, the substrate voltage VBB is higher than the voltage VRa1, a level of the input voltage VBBSW becomes a high level without depending on the output of the comparator A2 (first and third patterns of Table 2). That is, when the substrate voltage VBB is higher than the voltage VRa1, the limiting circuit 30 activates the negative voltage pumping circuit 20, regardless of the monitoring result of the gate/source voltage $V_{GS}$. Accordingly, the substrate voltage VBB does not increase longer.

Meanwhile, when the output of the comparator A3 is at a low level, that is, the substrate voltage VBB is lower than or equal to the voltage VRa1, a level of the input voltage VBBSW is equalized to the output of the comparator A2 (second and fourth patterns of Table 2). Accordingly, when the gate/source voltage $V_{GS}$ of the transistor M0 is lower than the gate/source voltage VRa of the transistor Tr5 (when the output of the comparator A2 is at a high level), the negative voltage pumping circuit 20 is activated, the threshold voltage of the transistor Tr5 increases, and the drain current $I_{da}$ decreases. Meanwhile, when the gate/source voltage $V_{GS}$ is higher than the gate/source voltage VRa (when the output of the comparator A2 is at a low level), the negative voltage pumping circuit 20 is inactivated, the threshold voltage of the transistor Tr5 decreases, and the drain current $I_{da}$ increases.

Figure 10A:
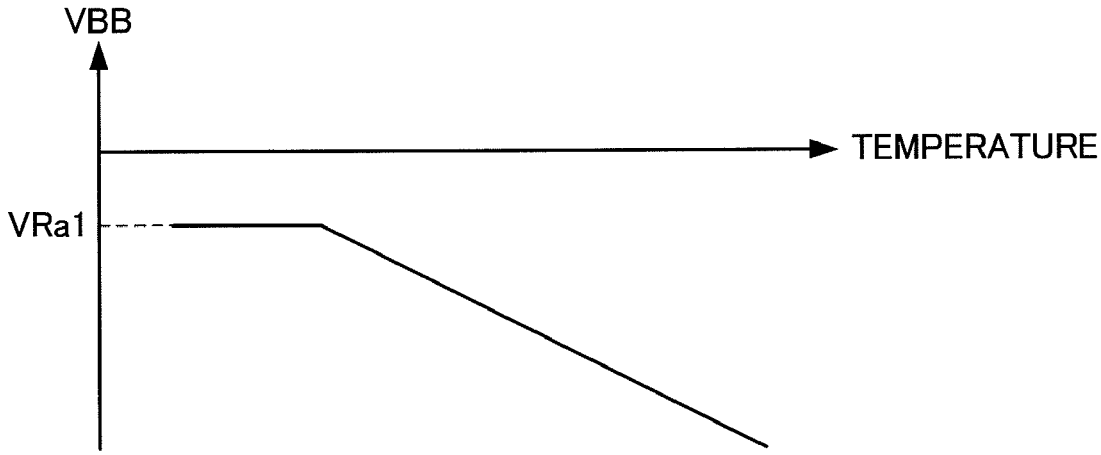
FIG. 10A is a graph illustrating a temperature variation of a substrate voltage VBB that is realized by processes of a monitoring circuit and a limiting circuit according to the first modification of the first embodiment of the present invention, when the gate/source voltage of the transistor whose threshold voltage is to be adjusted is in the "weak inversion region"

FIG. 10A is a graph illustrating a temperature variation of the substrate voltage VBB that is realized by processes of the monitoring circuit 10 and the limiting circuit 30 according to the first modification, when the gate/source voltage VRa of the transistor Tr5 is in the "weak inversion region". As illustrated in FIG. 10A, in the "weak inversion region", when the substrate voltage VBB is lower than or equal to the voltage VRa1, if the temperature increases, the substrate voltage VBB decreases.

Figure 10B:
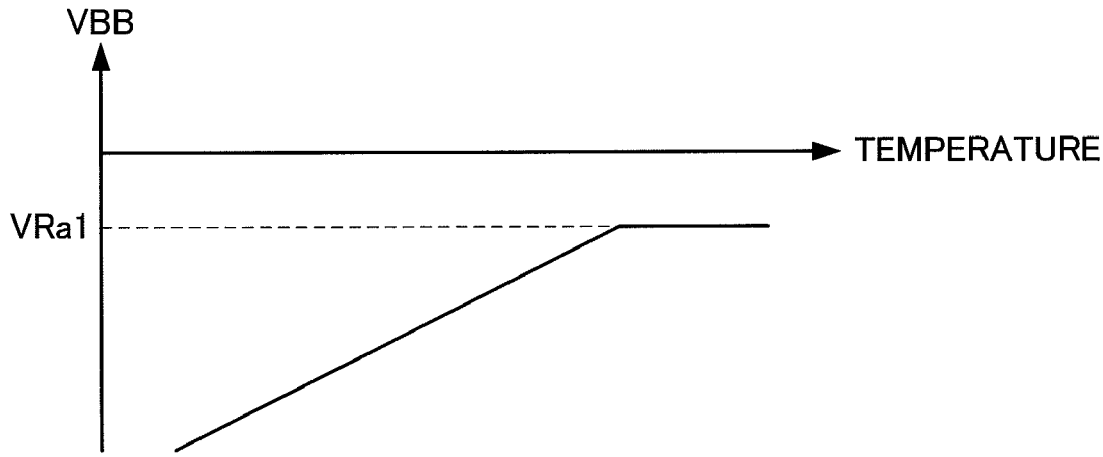
FIG. 10B is a graph illustrating a temperature variation of a substrate voltage VBB that is realized by processes of a monitoring circuit and a limiting circuit according to the first modification of the first embodiment of the present invention, when the gate/source voltage of the transistor whose threshold voltage is to be adjusted is in the "strong inversion region"

FIG. 10B is a graph illustrating a temperature variation of the substrate voltage VBB that is realized by processes of the monitoring circuit 10 and the limiting circuit 30 according to the first modification, when the gate/source voltage VRa of the transistor Tr5 is in the "strong inversion region". As illustrated in FIG. 10B, in the "strong inversion region", when the substrate voltage VBB is lower than or equal to the voltage VRa1, if the temperature increases, the substrate voltage VBB also increases.

Meanwhile, as illustrated in FIGS. 10A and 10B, the substrate voltage VBB does not become equal to or higher than the voltage VRa1. This is realized by a function of the limiting circuit 30 according to the first modification. As a result, the substrate voltage VBB can be maintained in an appropriate range. Since the lower limit of the substrate voltage VBB is not set, it is possible that the substrate voltage VBB decreases to a performance limit of the negative voltage pumping circuit 20.

Figure 11:
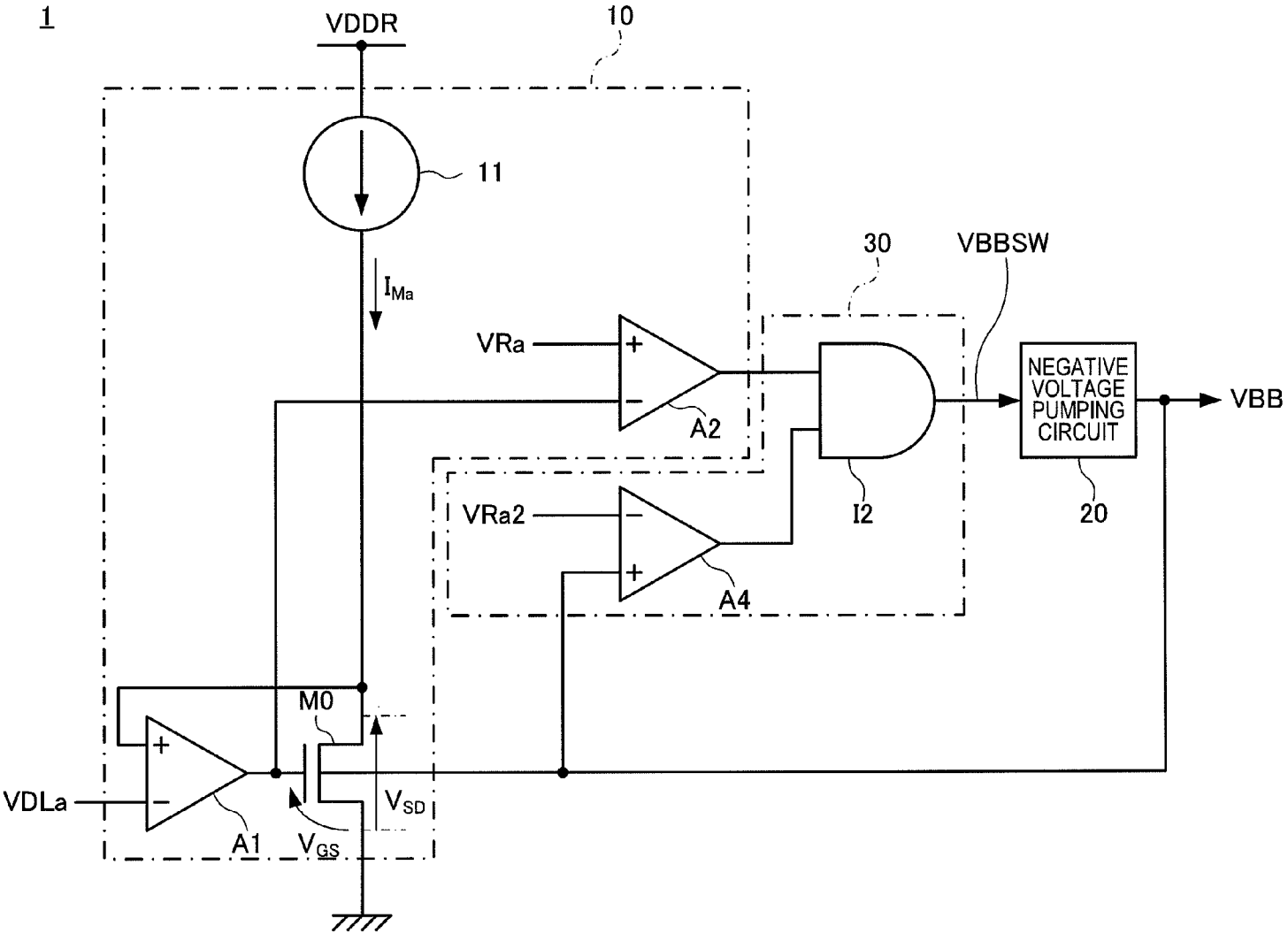
FIG. 11 is a circuit diagram of a semiconductor device according to a second modification of the first embodiment of the present invention.

FIG. 11 is a circuit diagram of a semiconductor device 1 according to the second modification. In the second modification, since the internal configuration of the limiting circuit 30 is different from the internal configuration of the circuit diagram of FIG. 1, the different configuration of the limiting circuit 30 will be mainly described.

As illustrated in FIG. 11, the limiting circuit 30 according to the second modification has the comparator A4 and the AND circuit I2, but does not have the comparator A3 and the OR circuit I1. The output terminal of the comparator A2 is connected to the AND circuit I2. The output of the AND circuit I2 is input as the input voltage VBBSW to the negative voltage pumping circuit 20.

Table 3 illustrates a correspondence relationship between the output of each of the comparators A2 and A4 and the AND circuit I2, and a control direction of the substrate voltage VBB and a variation direction of the threshold voltage of the transistor Tr5.

TABLE 3

| | A2 | A4 | VBBSW | VBB | THRESHOLD VOLTAGE |
|---|---|---|---|---|---|
| 1 | H | H | H | DOWN | UP |
| 2 | | L | L | UP | DOWN |
| 3 | L | H | L | UP | DOWN |
| 4 | | L | L | UP | DOWN |

As can be seen from Table 3, when the output of the comparator A4 is at a low level, that is, the substrate voltage VBB is lower than the voltage VRa2, a level of the input voltage VBBSW becomes a low level without depending on the output of the comparator A2 (second and fourth patterns of Table 3). That is, when the substrate voltage VBB is lower than the voltage VRa2, the limiting circuit 30 inactivates the negative voltage pumping circuit 20, regardless of the monitoring result of the gate/source voltage $V_{GS}$. Accordingly, the substrate voltage VBB does not decrease longer.

Meanwhile, when the output of the comparator A4 is at a high level, that is, the substrate voltage VBB is equal to or higher than the voltage VRa2, a level of the input voltage VBBSW is equalized to the output of the comparator A2 (first and third patterns of Table 3). Accordingly, when the gate/source voltage $V_{GS}$ of the transistor M0 is lower than the gate/source voltage VRa of the transistor Tr5 (when the output of the comparator A2 is at a high level), the negative voltage pumping circuit 20 is activated, the threshold voltage of the transistor Tr5 increases, and the drain current $I_{da}$ decreases. Meanwhile, when the gate/source voltage $V_{GS}$ is higher than the gate/source voltage VRa (when the output of the comparator A2 is at a low level), the negative voltage pumping circuit 20 is inactivated, the threshold voltage of the transistor Tr5 decreases, and the drain current $I_{da}$ increases.

Figure 12A:
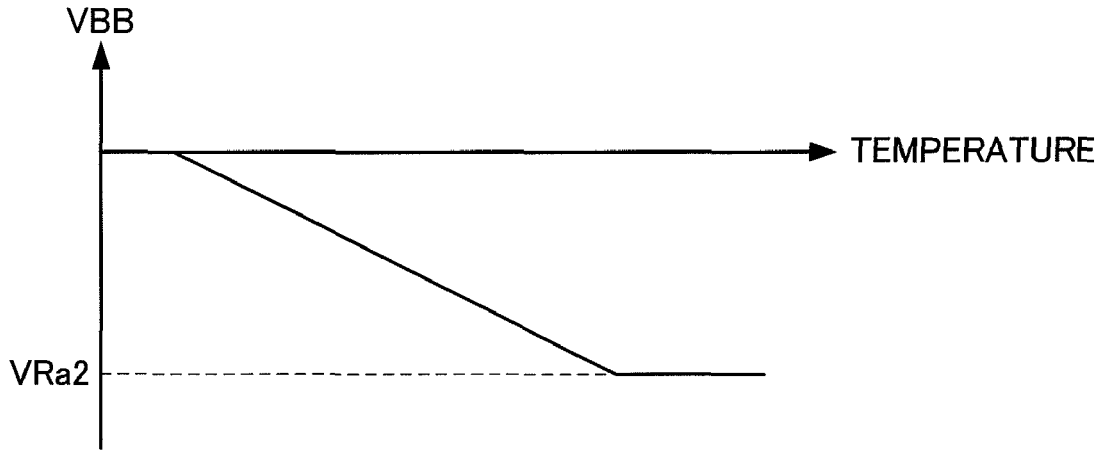
FIG. 12A is a graph illustrating a temperature variation of a substrate voltage VBB that is realized by processes of a monitoring circuit and a limiting circuit according to the second modification of the first embodiment of the present invention, when the gate/source voltage of the transistor whose threshold voltage is to be adjusted is in the "weak inversion region"

FIG. 12A is a graph illustrating a temperature variation of the substrate voltage VBB that is realized by processes of the monitoring circuit 10 and the limiting circuit 30 according to the second modification, when the gate/source voltage VRa of the transistor Tr5 is in the "weak inversion region". As illustrated in FIG. 12A, in the "weak inversion region", when the substrate voltage VBB is equal to or higher than the voltage VRa2, if the temperature increases, the substrate voltage VBB decreases.

Figure 12B:
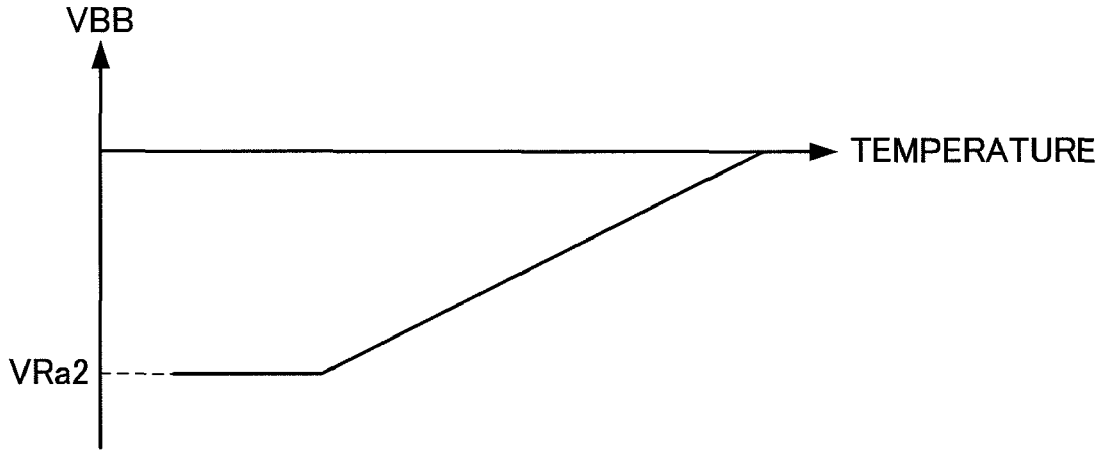
FIG. 12B is a graph illustrating a temperature variation of a substrate voltage VBB that is realized by processes of a monitoring circuit and a limiting circuit according to the second modification of the first embodiment of the present invention, when the gate/source voltage of the transistor whose threshold voltage is to be adjusted is in the "strong inversion region"

FIG. 12B is a graph illustrating a temperature variation of the substrate voltage VBB that is realized by processes of the monitoring circuit 10 and the limiting circuit 30 according to the second modification, when the gate/source voltage VRa of the transistor Tr5 is in the "strong inversion region". As illustrated in FIG. 12B, in the "strong inversion region", when the substrate voltage VBB is equal to or higher than the voltage VRa2, if the temperature increases, the substrate voltage VBB also increases.

Meanwhile, as illustrated in FIGS. 12A and 12B, the substrate voltage VBB does not become lower than or equal to the voltage VRa2. This is realized by a function of the limiting circuit 30 according to the second modification. As a result, the substrate voltage VBB can be maintained in an appropriate range. Since the upper limit of the substrate voltage VBB is not set, it is possible that the substrate voltage VBB increases to a ground level.

Figure 13:
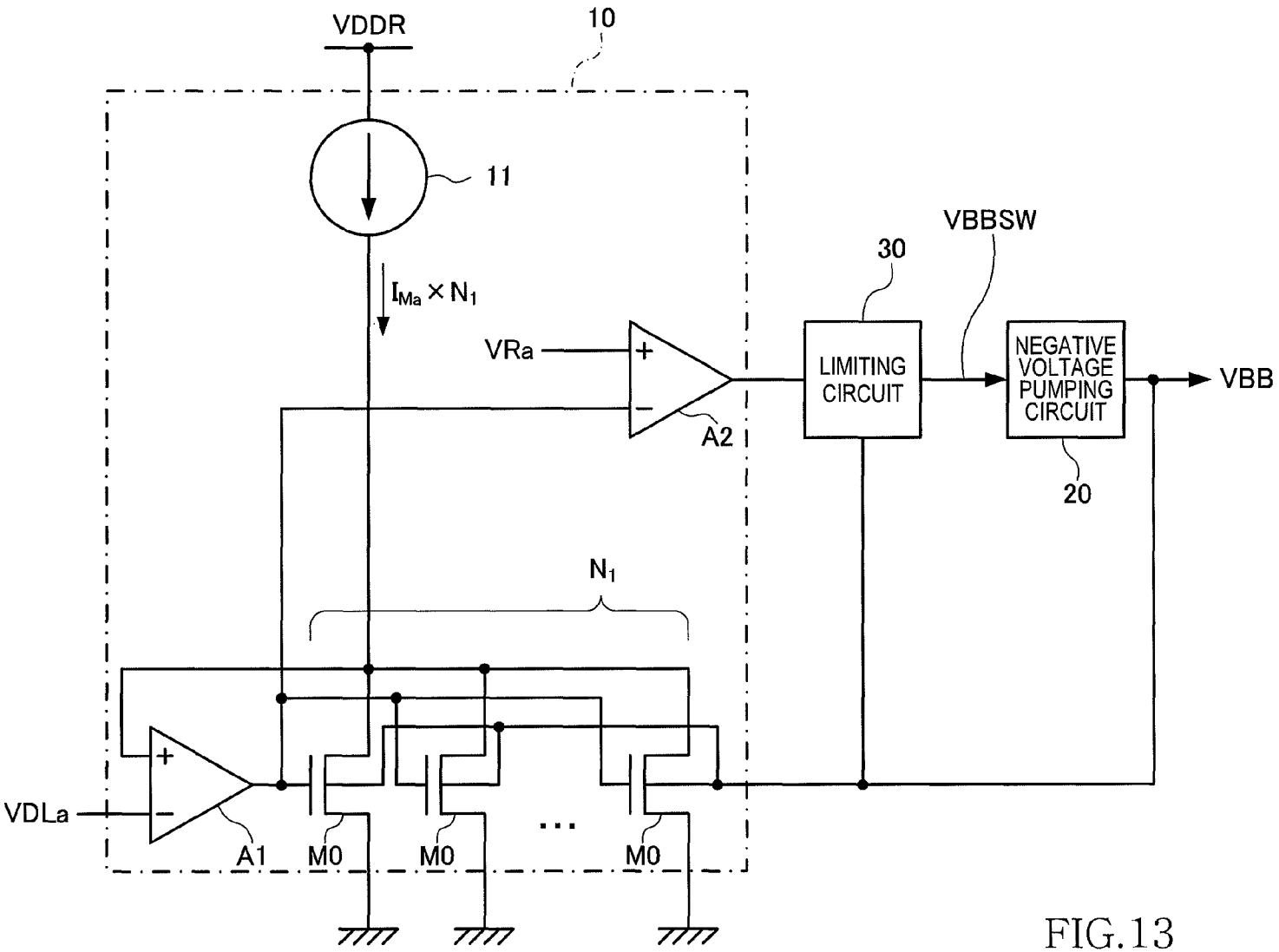
FIG. 13 is a circuit diagram of a semiconductor device according to a third modification of the first embodiment of the present invention.

FIG. 13 is a circuit diagram of a semiconductor device 1 according to the third modification. In the third modification, since the internal configuration of the monitoring circuit 10 is different from the internal configuration of the circuit diagram of FIG. 1, the different configuration of the monitoring circuit 10 will be mainly described. In FIG. 13, the internal configuration of the limiting circuit 30 is not illustrated, but is the same as that of FIG. 1. The monitoring circuit 10 according to the third modification is used when the gate/source voltage VRa of the transistor Tr5 whose threshold voltage is to be adjusted is in the "weak inversion region".

As illustrated in FIG. 13, in the monitoring circuit 10 according to the third modification, $N_1$ ($N_1 \geqq 2$) transistors M0 are used. The size of each transistor M0 is the same as the size of the transistor M0 of FIG. 1.

Each transistor M0 is disposed in parallel between the constant current source 11 and a ground terminal. The drain of each transistor M0 is connected to the non-inverting input terminal of the operational amplifier A1. Accordingly, due to a virtual short circuit of the operational amplifier A1, the source/drain voltage of each transistor M0 is equalized to the voltage VXa supplied to the inverting input terminal of the operational amplifier A1, that is, the source/drain voltage VDLa of the transistor Tr5.

By the above configuration, a drain current of each transistor is equalized. In order to cause each transistor M0 to function as a replica transistor, a current that is equal to a designed value $I_{Ma}$ of the drain current $I_{da}$ of the transistor Tr5 needs to be supplied to the drain of each transistor M0. Therefore, a value of the current that is supplied by the constant current source 11 needs to be set to a value $N_1 \times I_{Ma}$, which is $N_1$ times larger than the current $I_{Ma}$.

The gate of each transistor M0 is connected in parallel to the output terminal of the operational amplifier A1 and the inverting input terminal of the comparator A2. Accordingly, the voltage that is input to the inverting input terminal of the comparator A2 becomes an average of the gate/source voltages $V_{GS}$ of the plural transistors M0. Accordingly, even though the drain current of each transistor M0 is relatively small and an error of the gate/source voltage $V_{GS}$ of each transistor M0 is relatively large, a variation can be suppressed from being generated in the adjustment result of the threshold voltage of the transistor Tr5 due to the error.

Figure 14:
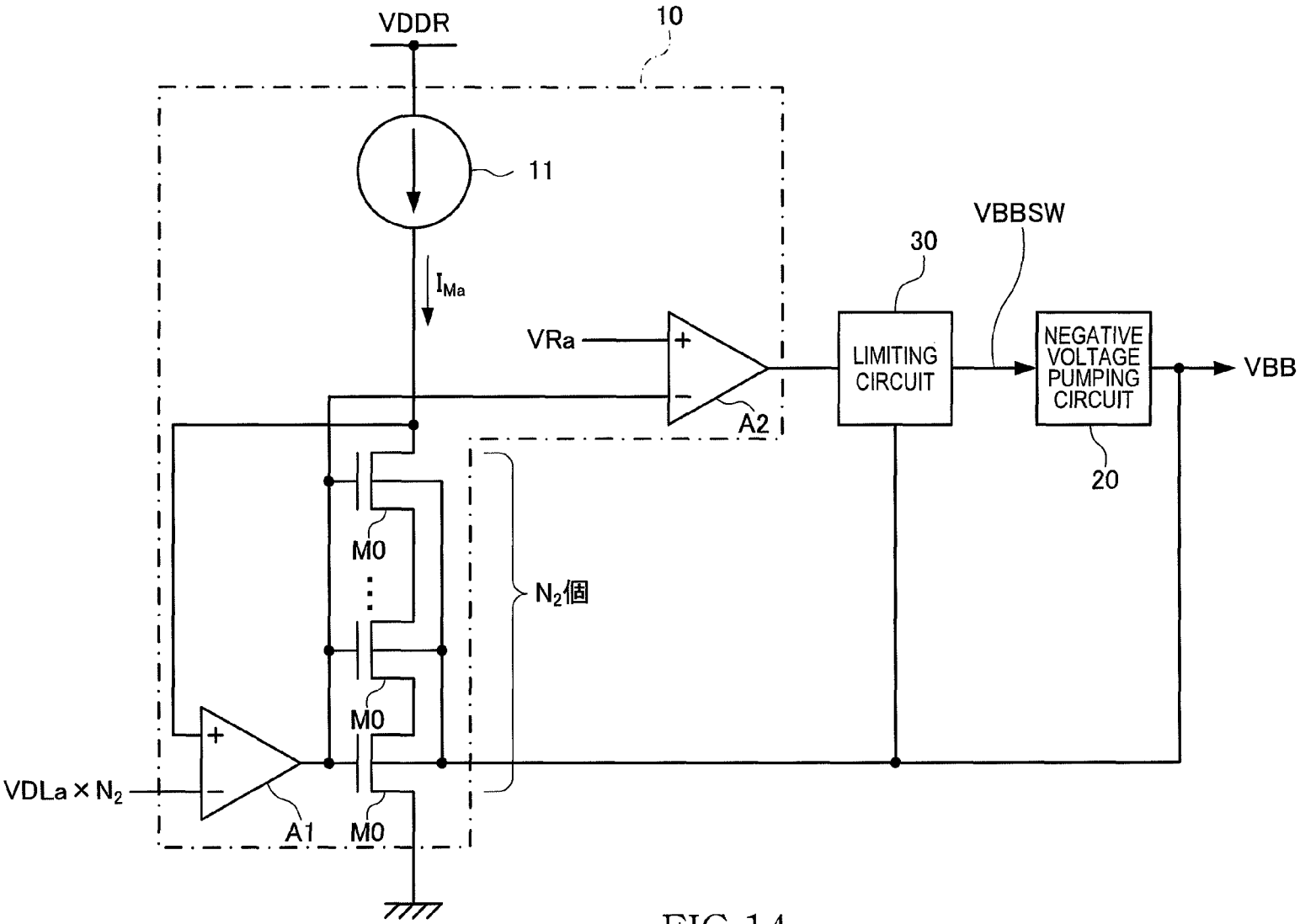
FIG. 14 is a circuit diagram of a semiconductor device according to a fourth modification of the first embodiment of the present invention.

FIG. 14 is a circuit diagram of a semiconductor device 1 according to the fourth modification. Even in the fourth modification, since the internal configuration of the monitoring circuit 10 is different from the internal configuration of the circuit diagram of FIG. 1, the different configuration of the monitoring circuit 10 will be mainly described. In FIG. 14, the internal configuration of the limiting circuit 30 is not illustrated, but is the same as that of FIG. 1. The monitoring circuit 10 according to the fourth modification is used when the gate/source voltage VRa of the transistor Tr5 whose threshold voltage is to be adjusted is in the "strong inversion region".

As illustrated in FIG. 14, in the monitoring circuit 10 according to the fourth modification, $N_2$ ($N_2 \geqq 2$) transistors M0 are used. The size of each transistor M0 is the same as the size of the transistor M0 of FIG. 1.

The transistors M0 are disposed in series between the constant current source 11 and the ground terminal, because current consumption becomes $N_2$ times and current consumption of the entire chips increases, if the $N_2$ transistors M0 are disposed in parallel. The drain of the transistor M0 that is closest to the constant current source 11 is connected to the non-inverting input terminal of the operational amplifier A1. Accordingly, the drain voltage becomes the voltage VXa that is supplied to the inverting input terminal of the operational amplifier A1, that is, the high-potential-side write potential VARY.

The gate of each transistor M0 is connected in parallel to the output terminal of the operational amplifier A1 and the inverting input terminal of the comparator A2. Accordingly, the voltage that is input to the inverting input terminal of the comparator A2 becomes an average of the gate/source voltages $V_{GS}$ of the plural transistors M0. Accordingly, even though an error of the gate/source voltage $V_{GS}$ of each transistor M0 is relatively large, a variation can be suppressed from being generated in the adjustment result of the threshold voltage of the transistor Tr5 due to the error.

The various modifications of the first embodiment have been described. In addition to these modifications, various applications or modifications can be considered. As an example of the applications, the threshold voltage of the N-channel MOS transistor Tr6 may be configured to be adjusted, although the threshold voltage of the N-channel MOS transistor Tr5 in the sense amplifier is adjusted in the first embodiment. Since the sizes of the transistors Tr5 and Tr6 are equal to each other, the threshold voltage of the transistor Tr6 can be appropriately adjusted by using the substrate voltage VBB generated in the first embodiment as the substrate voltage of the transistor Tr6.

Figure 15:
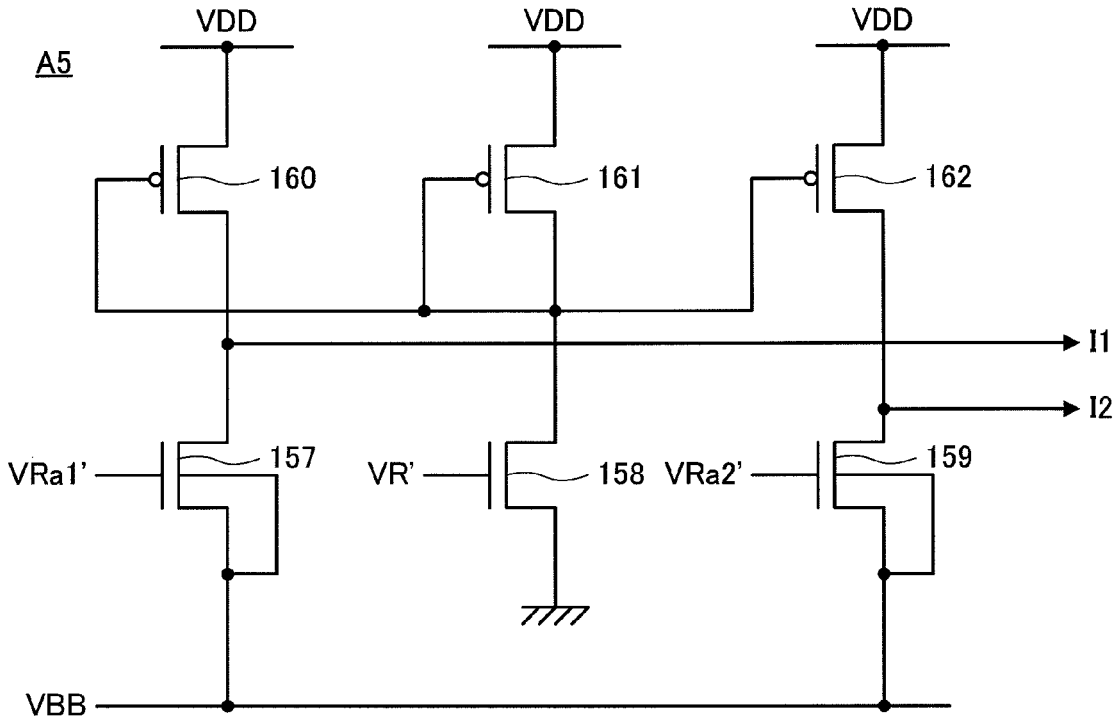
FIG. 15 is a circuit diagram of an alternative circuit of a comparator according to the first embodiment of the present invention.

In the first embodiment, the comparators A3 and A4 are used. However, instead of the comparators A3 and A4, a circuit AS illustrated in FIG. 15 may be used. As illustrated in FIG. 15, the circuit AS has N-channel MOS transistors 157 to 159 and P-channel MOS transistors 160 to 162. The transistors 157 and 159 are diode connected, and sources thereof are supplied with the substrate voltage VBB. Gates of the transistors 157 and 159 are supplied with voltages VRa1' and VRa2', respectively. The conditions VRa1'=VRa1+VR' and VRa2'=VRa2+VR' are satisfied. The voltage VR' is used as a bias voltage of the constant current source. Drains of the transistors 157 and 159 are connected to drains of the transistors 160 and 162.

Finally, specific numerical values of individual parameters that are used in the semiconductor device 1 according to the first embodiment are exemplified. First, a W/L ratio of the transistor Tr5 is 1.0 μm/0.1 μm and the voltage VDLa is 1.0 V. The upper limit VRa1 of the substrate voltage VBB is preferably set to −0.1 V and the lower limit VRa2 thereof is preferably set to −0.7 V. In this case, the voltage VR' that is used in the circuit illustrated in FIG. 15 is preferably set to 0.7 V. When the gate/source voltage VRa of the transistor Tr5 is in the "weak inversion region", VRa=110 mV and $I_M$=1 μA are preferable. Meanwhile, when the gate/source voltage VRa of the transistor Tr5 is in the "strong inversion region", VRa=1.0 V and $I_M$=24 μA are preferable. The number $N_1$ of transistors M0 that are used in the third modification is preferably set to 8, and the number $N_2$ of transistors M0 that are used in the fourth modification is preferably set to 16.

Figure 16:
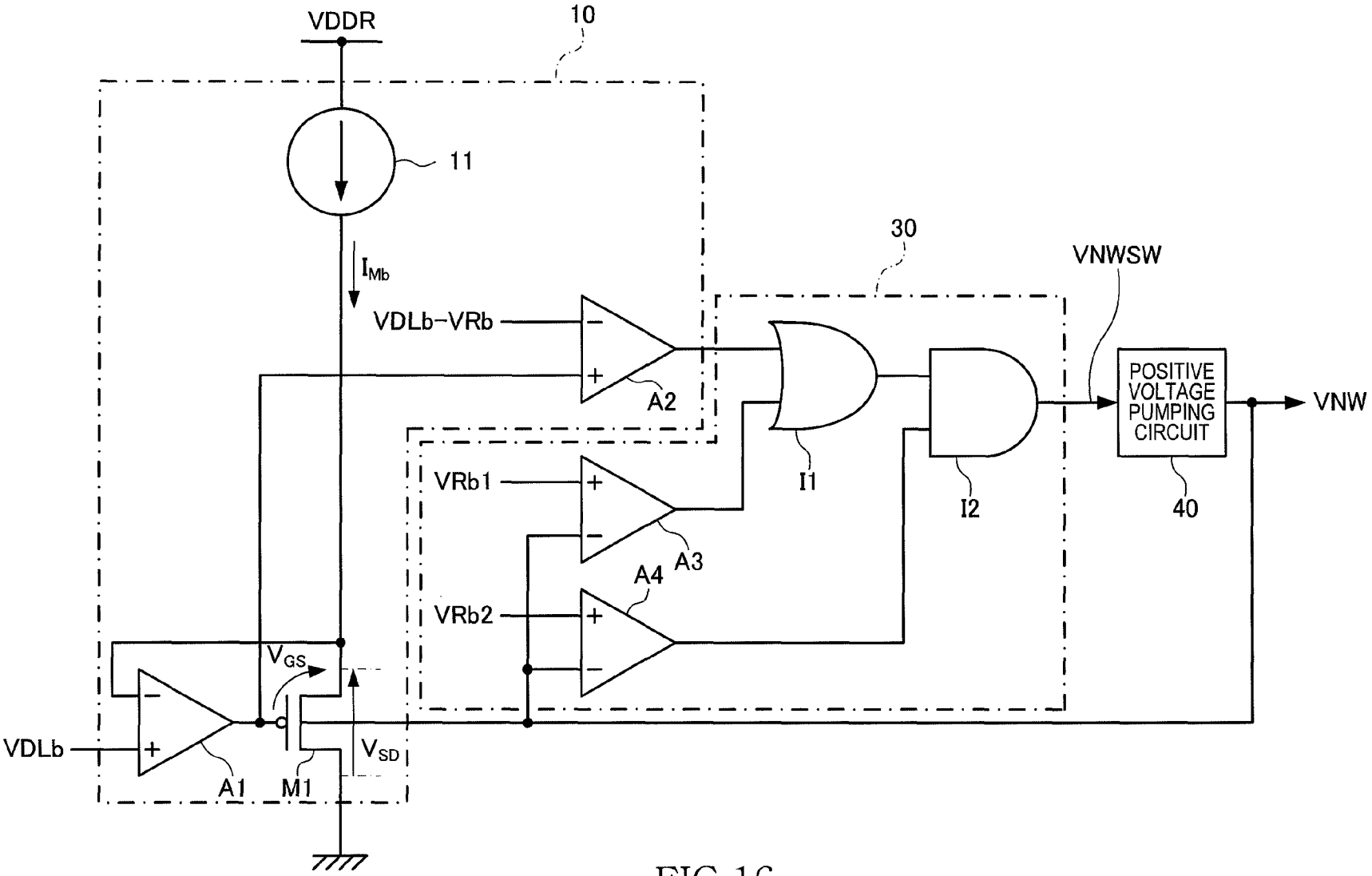
FIG. 16 is a circuit diagram of a semiconductor device according to a second embodiment of the present invention.

FIG. 16 is a circuit diagram of a semiconductor device 1 according to a second embodiment of the present invention.

The semiconductor device 1 according to the second embodiment is different from the semiconductor device according to the first embodiment in that the threshold voltage of the P-channel MOS transistor Tr3 in the sense amplifier SA illustrated in FIG. 2 is adjusted.

The semiconductor device 1 according to the second embodiment includes a positive voltage pumping circuit 40, instead of the negative voltage pumping circuit 20. The positive voltage pumping circuit 40 is a boosting circuit that can generate a voltage, which is at least two times larger than the voltage VDD, and the generated voltage becomes a substrate voltage VNW. The positive voltage pumping circuit 40 starts to generate the substrate voltage VNW, when a level of an input voltage VNWSW becomes a high level. When the positive voltage pumping circuit 40 generates the substrate voltage VNW, the substrate voltage VNW gradually increases and finally becomes a predetermined value. Meanwhile, when the level of the input voltage VNWSW becomes a low level, the positive voltage pumping circuit 40 stops generation of the substrate voltage VNW. When the positive voltage pumping circuit 40 stops the generation of the substrate voltage VNW, the substrate voltage VNW gradually decreases due to a junction leak, and a level thereof finally becomes a level between a ground level and VDD-Vth, although the level is different according to the circuit configuration. In this case, Vth is a threshold voltage of the transistor used to pull up the voltage level to VDD.

The monitoring circuit 10 according to the second embodiment has a P-channel MOS transistor M1, instead of the N-channel MOS transistor M0. The transistor M1 is a replica transistor of the P-channel MOS transistor Tr3. The monitoring circuit 10 monitors a gate/source voltage $V_{GS}$ that is needed when the transistor M1 flows a current $I_{Mb}$ having a given designed value. The value of the current $I_{Mb}$ that is supplied from the constant current source 11 is a designed value of the drain current $I_{db}$ (refer to FIG. 2) of the transistor Tr3.

The non-inverting input terminal of the operational amplifier A1 is supplied with a voltage VXb, and the inverting input terminal thereof is supplied with a source/drain voltage $V_{SD}$ of the transistor M1. The inverting input terminal of the comparator A2 is supplied with a differential voltage VXb-VYb of the voltage VXb and the voltage VYb, and the non-inverting input terminal thereof is supplied with the output voltage of the operational amplifier A1, that is, a differential voltage $V_{SD}$-$V_{GS}$ of the voltage $V_{SD}$ and the gate/source voltage $V_{GS}$.

Similar to the first embodiment, when the gate/source voltage VRb is in the "strong inversion region", the voltage VXb is set as the source/drain voltage VDLb of the transistor Tr3, and when the gate/source voltage VRb is in the "weak inversion region", the voltage VXb is set as the high-potential-side write potential VARY.

Similar to the first embodiment, the voltage VYb is the gate/source voltage VRa of the transistor Tr5. However, the specific value of the voltage VYb may be individually determined when the gate/source voltage VRb is in the "weak inversion region" or the "strong inversion region".

Similar to the first embodiment, the source/drain voltage $V_{SD}$ of the transistor M1 is equalized to the voltage VXb due to a virtual short circuit of the operational amplifier A1. Since the current $I_{Mb}$ is supplied from the constant current source 11 to the drain of the transistor M0, the gate/source voltage $V_{GS}$ of the transistor M0 is determined. However, the voltage $V_{GS}$ is different according to the value of the substrate voltage VNW, similar to the gate/source voltage $V_{GS}$ of the transistor M0 described in the first embodiment.

The comparator A2 compares the voltage $V_{SD}$-$V_{GS}$ and the voltage VXb-VYb, and outputs a high-level signal when the voltage $V_{SD}$-$V_{GS}$ is higher than the voltage VXb-VYb and outputs a low-level signal when the voltage $V_{SD}$-$V_{GS}$ is not higher than the voltage VXb-VYb.

The limiting circuit 30 defines the operation of the positive voltage pumping circuit 40, regardless of the monitoring result of the gate/source voltage $V_{GS}$ of the transistor M1, in response to an excess of the substrate voltage VNW with respect to the predetermined value. By this configuration, the limiting circuit 30 can maintain the substrate voltage VNW in an appropriate range.

The non-inverting input terminal of each of the comparators A3 and A4 in the limiting circuit 30 is supplied with the substrate voltage VNW. Meanwhile, the inverting input terminal of the comparator A3 is supplied with a voltage VRb2 corresponding to an upper limit of the substrate voltage VNW, and the inverting input terminal of the comparator A4 is supplied with a voltage VRb1 corresponding to a lower limit of the substrate voltage VNW.

The output of the AND circuit I2 is input as the input voltage VNWSW to the positive voltage pumping circuit 40.

Table 4 illustrates a correspondence relationship between the output of each of the comparators A2 to A4, the OR circuit I1, and the AND circuit I2, and a control direction of the substrate voltage VNW and a variation direction of the threshold voltage of the transistor Tr3.

TABLE 4

| | A2 | A3 | I1 | A4 | VNWSW | VNW | THRESHOLD VOLTAGE |
|---|---|---|---|---|---|---|---|
| 1 | H | H | H | H | H | UP | UP |
| 2 | | | | L | L | DOWN | DOWN |
| 3 | | L | | H | H | UP | UP |
| 4 | | | | L | L | DOWN | DOWN |
| 5 | L | H | | H | H | UP | UP |
| 6 | | | | L | L | DOWN | DOWN |
| 7 | | L | L | H | L | DOWN | DOWN |
| 8 | | | | L | L | DOWN | DOWN |

As can be seen from Table 4, when the output of the comparator A3 is at a high level, that is, the substrate voltage VNW is lower than the voltage VRb1, a level of the input voltage VNWSW becomes a high level without depending on the output of the comparator A2 (first and fourth patterns of Table 4. The second and sixth patterns that are displayed with a gray color are not actually realized). That is, when the substrate voltage VNW is lower than the voltage VRb1, the limiting circuit 30 activates the positive voltage pumping circuit 40, regardless of the monitoring result of the gate/source voltage $V_{GS}$. Accordingly, the substrate voltage VNW does not decrease longer.

When the output of the comparator A4 is at a low level, that is, the substrate voltage VNW is higher than the voltage VRb2, a level of the input voltage VNWSW becomes a low level without depending on the output of the comparator A2 (fourth and eighth patterns of Table 4). That is, when the substrate voltage VNW is higher than the voltage VRb2, the limiting circuit 30 inactivates the positive voltage pumping circuit 40, regardless of the monitoring result of the gate/source voltage $V_{GS}$Accordingly, the substrate voltage VNW does not increase longer.

Meanwhile, when the output of the comparator A3 is at a low level and the output of the comparator A4 is at a high level, that is, the substrate voltage VNW is in a range between the voltage VRb1 and the voltage VRb2, the input voltage VNWSW is equalized to the output of the comparator A2 (third and seventh patterns of Table 4). Accordingly, when the gate/source voltage $V_{GS}$ of the transistor M0 is lower than the gate/source voltage VRb of the transistor Tr3 (when the output of the comparator A2 is at a high level), the positive voltage pumping circuit 40 is activated, the threshold voltage of the transistor Tr3 increases, and the drain current $I_{db}$ decreases. Meanwhile, when the voltage $V_{GS}$ is higher than the voltage VRb (when the output of the comparator A2 is at a low level), the positive voltage pumping circuit 40 is inactivated, the threshold voltage of the transistor Tr3 decreases, and the drain current $I_{db}$ increases.

Figure 17A:
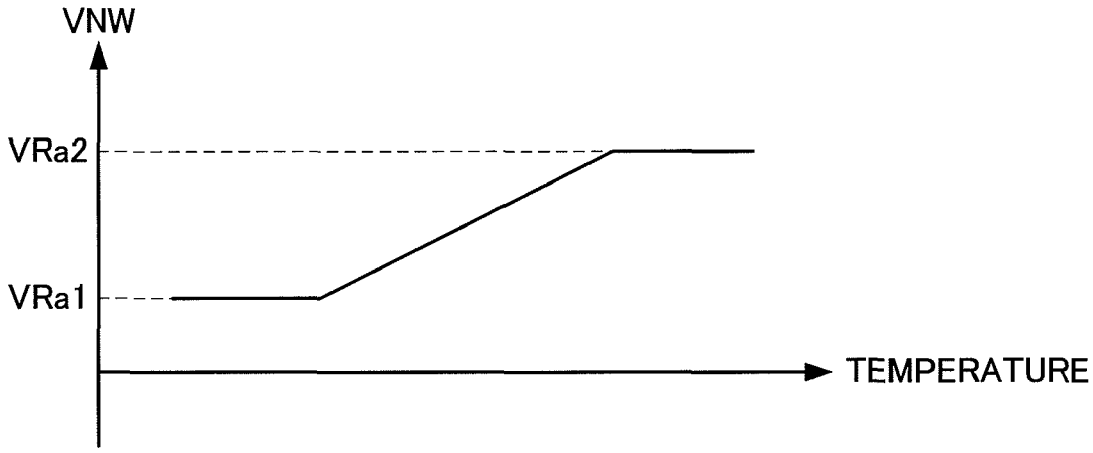
FIG. 17A is a graph illustrating a temperature variation of a substrate voltage VBB that is realized by processes of a monitoring circuit and a limiting circuit according to the second embodiment of the present invention, when the gate/source voltage of the transistor whose threshold voltage is to be adjusted is in the "weak inversion region"

FIG. 17A is a graph illustrating a temperature variation of the substrate voltage VNW that is realized by processes of the monitoring circuit 10 and the limiting circuit 30, when the gate/source voltage VRb of the transistor Tr3 is in the "weak inversion region". As illustrated in FIG. 17A, in the "weak inversion region", when the substrate voltage VNW is in a range between the voltage VRb1 and the voltage VRb2, if the temperature increases, the substrate voltage VNW increases. This corresponds to the case where the drain current $I_{db}$ increases, if the temperature is higher in the "weak inversion region" (drain current $I_{db}$ has a positive temperature characteristic). That is, the higher the temperature is, the higher the drain current $I_{db}$ becomes. Therefore, the monitoring circuit 10 increases the threshold voltage of the transistor Tr3, that is, increases the substrate voltage VNW, and decreases the drain current $I_{db}$.

Figure 17B:
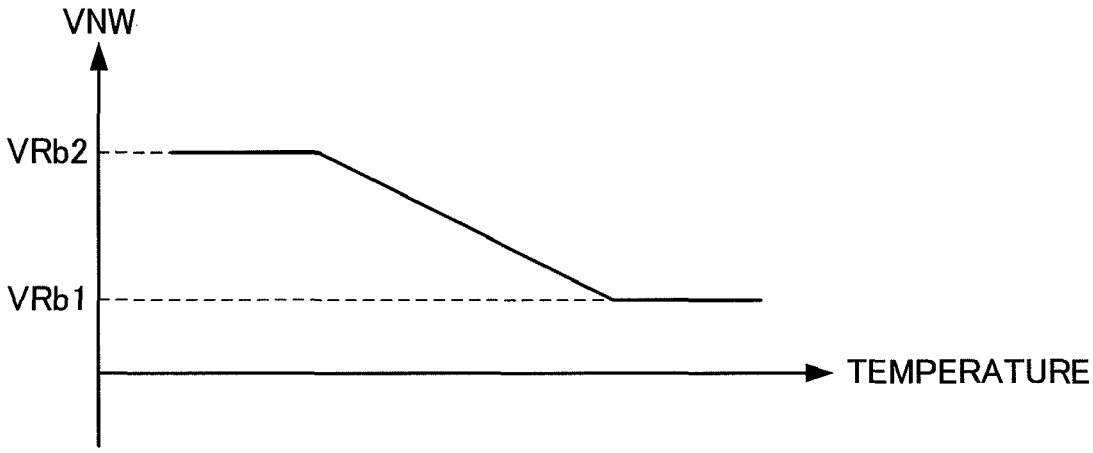
FIG. 17B is a graph illustrating a temperature variation of a substrate voltage VBB that is realized by processes of a monitoring circuit and a limiting circuit according to the second embodiment of the present invention, when the gate/source voltage of the transistor whose threshold voltage is to be adjusted is in the "strong inversion region"

FIG. 17B is a graph illustrating a temperature variation of the substrate voltage VNW that is realized by processes of the monitoring circuit 10 and the limiting circuit 30, when the gate/source voltage VRb of the transistor Tr3 is in the "strong inversion region". As illustrated in FIG. 17B, in the "strong inversion region", when the substrate voltage VNW is in a range between the voltage VRb1 and the voltage VRb2, if the temperature increases, the substrate voltage VNW also increases. This corresponds to the case where the drain current $I_{db}$ decreases, if the temperature is higher in the "strong inversion region" (drain current $I_{db}$ has a negative temperature characteristic). That is, the higher the temperature is, the lower the drain current $I_{db}$ becomes. Therefore, the monitoring circuit 10 decreases the threshold voltage of the transistor Tr3, that is, decreases the substrate voltage VNW, and increases the drain current $I_{db}$.

Meanwhile, as illustrated in FIGS. 17A and 17B, the substrate voltage VNW does not become lower than or equal to the voltage VRb1 or equal to or higher than the voltage VRb2. This is realized by a function of the limiting circuit 30. As a result, the substrate voltage VNW can be maintained in an appropriate range. That is, in the N-type region NWELL illustrated in FIG. 3, pressure resistance or forward bias of a boundary portion with each p+ diffusion layer can be appropriately maintained.

As described above, according to the semiconductor device 1, the substrate voltage VNW can be maintained in an appropriate range while the substrate voltage VNW is controlled to adjust the threshold voltage of the transistor Tr3.

In the second embodiment, various modifications can be considered. Hereinafter, one modification of the second embodiment will be described. In this modification, the variation of the adjustment result of the threshold voltage of the transistor Tr3 is suppressed. That is, similar to the first embodiment, in the second embodiment, since the channel width W and the channel length L of each of the transistor Tr3 whose threshold voltage is to be adjusted and the transistor M1 are small, a mismatch of the threshold voltage increases and causes the variation of the adjustment result. In this modification, the variation can be suppressed.

Figure 18:
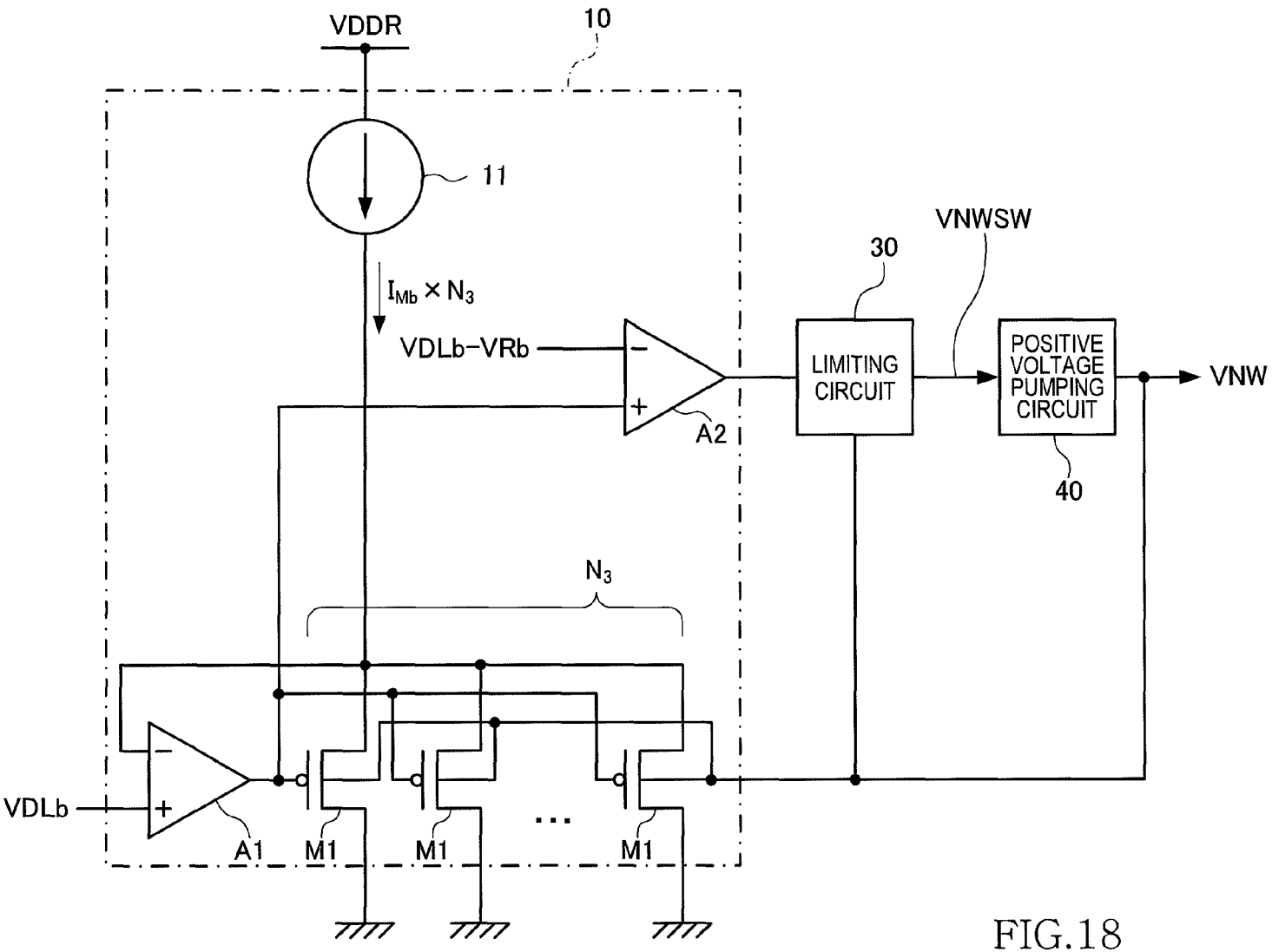
FIG. 18 is a circuit diagram of a semiconductor device according to a modification of the second embodiment of the present invention.

FIG. 18 is a circuit diagram of a semiconductor device 1 according to this modification. In this modification, since the internal configuration of the monitoring circuit 10 is different from the internal configuration of the circuit diagram of FIG. 16, the different configuration of the monitoring circuit 10 will be mainly described. In FIG. 18, the internal configuration of the limiting circuit 30 is not illustrated, but is the same as that of FIG. 16. The monitoring circuit according to this modification is used when the gate/source voltage VRb of the transistor Tr1 whose threshold voltage is to be adjusted is in the "weak inversion region".

As illustrated in FIG. 18, in the monitoring circuit 10 according to this modification, $N_3$ ($N_3 \geqq 2$) transistors M1 are used. The size of each transistor M1 is the same as the size of the transistor M1 of FIG. 16.

The transistors M1 are disposed in parallel between the constant current source 11 and the ground terminal. The drain of each transistor M1 is connected to the non-inverting input terminal of the operational amplifier A1. Accordingly, due to a virtual short circuit of the operational amplifier A1, the source/drain voltage of each transistor M1 is equalized to the voltage VXb supplied to the inverting input terminal of the operational amplifier A1, that is, the source/drain voltage VDLb of the transistor Tr3.

By the above configuration, a drain current of each transistor is equalized. In order to cause each transistor M1 to function as a replica transistor, a current that is equal to a designed value $I_{Mb}$ of the drain current $I_{db}$ of the transistor Tr3 needs to be supplied to the drain of each transistor M1. Therefore, a value of the current that is supplied by the constant current source 11 needs to be set to a value $N_3 \times I_{Mb}$, which is $N_3$ times larger than the current $I_{Mb}$.

The gate of each transistor M1 is connected in parallel to the output terminal of the operational amplifier A1 and the inverting input terminal of the comparator A2. Accordingly, the voltage that is input to the non-inverting input terminal of the comparator A2 becomes an average of the differential voltages $V_{SD}$-$V_{GS}$ of the plural transistors M1. Accordingly, even though the drain current of each transistor M1 is relatively small and an error of the differential voltage $V_{SD}$-$V_{GS}$ of each transistor M1 is relatively large, a variation can be suppressed from being generated in the adjustment result of the threshold voltage of the transistor Tr3 due to the error.

Finally, specific numerical values of individual parameters that are used in the semiconductor device 1 according to the second embodiment are exemplified. First, a W/L ratio of the transistor Tr3 is 1.0 μm/0.1 μm and the voltage VDLb is 1.0 V. The lower limit VRb1 of the substrate voltage VNW is preferably set to VDL and the upper limit VRb2 thereof is preferably set to VDL +1.5 V. When the gate/source voltage VRb of the transistor Tr3 is in the "weak inversion region", VRb=200 mV and $I_M$=1 μA are preferable. The number $N_3$ of transistors M1 that are used in this modification is preferably set to 8.

When the upper limit VRb2 is set to VDL +1.5 V, a voltage higher than VDD is input to the comparator A4. Accordingly, a power supply voltage of VDL +1.5 V or more is needed.

It is apparent that the present invention is not limited to the above embodiments, but may be modified and changed without departing from the scope and spirit of the invention.

What is claimed is:

1. A semiconductor device comprising:

a word line;

a first bit line;

a second bit line;

at least one memory cell which is coupled between the word line and the first bit line, and which comprises a memory cell transistor;

a sense amplifier circuit comprising:

a first transistor which comprises a first substrate, a first gate coupled to the second bit line, and a first source-drain path coupled between a first voltage node and the first bit line;

a second transistor which comprises a second substrate, a second gate coupled to the first bit line, and a second source-drain path coupled between the first voltage node and the second bit line;

a third transistor which comprises a third gate coupled to the second bit line and a third source-drain path coupled between a second voltage node and the first bit line; and a fourth transistor which comprises a fourth gate coupled to the first bit line and a fourth source-drain path coupled between the second voltage node and the second bit line;

a replica transistor which is a replicate of the first transistor, and which comprises a third substrate, a firth gate and a firth source-drain path;

a voltage generating circuit which generates a substrate bias voltage and supplying the substrate bias voltage in common to the first substrate of the first transistor, the second substrate of the second transistor, and the third substrate of the replica transistor;

a monitor circuit which monitors a level of the substrate bias voltage; and a control circuit which is coupled to the replica transistor and the monitor circuit, and which controls the voltage generating circuit in response to an output of the monitor circuit and a replica voltage across the fifth source-drain path of the replica transistor.

2. The semiconductor device as claimed in claim 1, wherein the control circuit allows the voltage generating circuit to generate the substrate bias voltage in response to the replica voltage when the output of the monitor circuit indicates that the level of the substrate bias voltage is in a range between a first reference voltage and a second reference voltage greater than the first reference voltage.

3. The semiconductor device as claimed in claim 2, wherein, when the output of the monitor circuit indicates that the level of the substrate bias voltage is lower than the first reference voltage, the control circuit prohibits the voltage generating circuit from generating the substrate bias voltage regardless of the replica voltage.

4. The semiconductor device as claimed in claim 3, wherein, when the output of the monitor circuit indicates that the level of the substrate bias voltage is greater than the second reference voltage, the control circuit forces the voltage generating circuit to generate the substrate bias voltage regardless of the replica voltage.

5. The semiconductor device as claimed in claim 2, wherein the monitor circuit comprises:

a first comparator which comprises a first input terminal supplied with the substrate bias voltage and a second input terminal supplied with the first reference voltage, and the first comparator compares the substrate bias voltage with first reference voltage; and a second comparator which comprises a third input terminal supplied with the substrate bias voltage and a fourth input terminal supplied with the second reference voltage, and the second comparator compares the substrate bias voltage with the second reference voltage;

wherein the output of the monitor circuit is determined by output signals of the first comparator and the second comparator.

6. The semiconductor device as claimed in claim 5, wherein the control circuit includes a third comparator that includes a fifth input terminal supplied with a third reference voltage and a sixth input terminal supplied with a voltage changed in response to the replica voltage.

7. The semiconductor device as claimed in claim 6, wherein the sixth input terminal is coupled to the fifth gate of the replica transistor and a voltage of the fifth gate of the replica transistor is changed in response to the replica voltage.

8. The semiconductor device as claimed in claim 1, wherein the memory cell transistor includes a fourth substrate and the voltage generating circuit supplies the substrate bias voltage to the fourth substrate of the memory cell transistor.

9. The semiconductor device as claimed in claim 8, wherein the memory cell includes a capacitor, and the memory cell transistor is provided between the first bit line and the capacitor.

10. The semiconductor device as claimed in claim 8, further comprising:

an additional word line; and an additional memory cell coupled between the additional word line and the second bit line, and the additional memory cell comprises an additional memory cell transistor;

wherein the additional memory cell transistor includes a fifth substrate and the voltage generating circuit supplies the substrate bias voltage to the fifth substrate of the additional memory cell transistor.

* * * * *

UNITED STATES PATENT AND TRADEMARK OFFICE

CERTIFICATE OF CORRECTION

PATENT NO. : 8,217,712 B2
APPLICATION NO. : 12/647259
DATED : July 10, 2012
INVENTOR(S) : Shinichi Miyatake, Seiji Narui and Hitoshi Tanaka It is certified that error appears in the above-identified patent and that said Letters Patent is hereby corrected as shown below:

In the Specifications

Column 4, Line 29: delete "miring" and insert - - wiring - -

Column 6, Line 59: delete "Tr1" and insert - - Tr3 - -

Column 16, Line 60: delete "AS" and insert - - A5 - -

Column 19, Line 13: delete "$V_{GS}$Accordingly," and insert - - $V_{GS}$. Accordingly, - -

Column 20, Line 27: delete "circuit" and insert - - circuit 10 - -

Column 20, Line 29: delete "Tr1" and insert - - Tr3 - -

Signed and Sealed this
Tenth Day of September, 2013

Teresa Stanek Rea
*Acting Director of the United States Patent and Trademark Office*